US006811944B2

(12) United States Patent
Higuchi et al.

(10) Patent No.: US 6,811,944 B2
(45) Date of Patent: Nov. 2, 2004

(54) TONER, METHOD FOR MANUFACTURING THE TONER, AND IMAGE FORMING METHOD AND APPARATUS USING THE TONER

(75) Inventors: Hiroto Higuchi, Numazu (JP); Fumihiro Sasaki, Fuji (JP); Yasuaki Iwamoto, Numazu (JP); Hiroshi Nakai, Yokohama (JP); Bing Shu, Mishima (JP); Hiroaki Matsuda, Numazu (JP); Maiko Kondo, Numazu (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/786,549

(22) Filed: Feb. 26, 2004

(65) Prior Publication Data

US 2004/0166429 A1 Aug. 26, 2004

Related U.S. Application Data

(62) Division of application No. 09/965,826, filed on Oct. 1, 2001.

(30) Foreign Application Priority Data

| | | |
|---|---|---|
| Sep. 29, 2000 | (JP) | 2000-298734 |
| Oct. 25, 2000 | (JP) | 2000-324957 |
| Feb. 2, 2001 | (JP) | 2001-026396 |
| Aug. 1, 2001 | (JP) | 2001-233944 |

(51) Int. Cl.[7] ..... G03G 15/20
(52) U.S. Cl. ..... 430/124; 399/283; 399/284
(58) Field of Search ..... 430/124; 399/283, 399/284

(56) References Cited

U.S. PATENT DOCUMENTS

| | | | |
|---|---|---|---|
| 4,702,986 | A | 10/1987 | Imai et al. |
| 4,762,763 | A | 8/1988 | Nomura et al. |
| 4,908,290 | A | 3/1990 | Watanabe et al. |
| 4,933,250 | A | 6/1990 | Nakayama et al. |
| 4,950,573 | A | 8/1990 | Yamaguchi et al. |
| 4,956,258 | A | 9/1990 | Watanabe et al. |
| 4,980,258 | A | 12/1990 | Aoki et al. |
| 5,168,028 | A | 12/1992 | Nanya et al. |
| 5,288,677 | A | 2/1994 | Chung et al. |
| 5,344,732 | A | 9/1994 | Chiba et al. |
| 5,368,972 | A | 11/1994 | Yamashita et al. |
| 5,403,690 | A | 4/1995 | Kuramoto et al. |
| 5,429,901 | A | 7/1995 | Muto et al. |
| 5,554,478 | A | 9/1996 | Kuramoto et al. |
| 5,721,083 | A | 2/1998 | Masuda et al. |
| 5,879,849 | A | 3/1999 | Sawada et al. |
| 5,882,832 | A | 3/1999 | Tosaka et al. |
| 5,935,751 | A | 8/1999 | Matsuoka et al. |
| 6,004,715 | A | 12/1999 | Suzuki et al. |
| 6,010,814 | A | 1/2000 | Kotsugai et al. |
| 6,074,794 | A | 6/2000 | Fushimi et al. |
| 6,074,795 | A | 6/2000 | Watanabe et al. |
| 6,103,441 | A | 8/2000 | Tomita et al. |
| 6,168,894 | B1 | 1/2001 | Aoki et al. |
| 6,180,298 | B1 | 1/2001 | Kuroda et al. |
| 6,238,835 | B1 | 5/2001 | Tavernier et al. |
| 6,258,502 | B1 | 7/2001 | Nakamura et al. |
| 6,303,257 | B1 | 10/2001 | Hasegawa et al. |
| 6,303,258 | B1 | 10/2001 | Katoh et al. |
| 6,335,137 | B1 | 1/2002 | Suzuki et al. |
| 6,337,957 | B1 | 1/2002 | Tamaki et al. |
| 6,360,068 | B1 | 3/2002 | Kinoshita et al. |
| 6,363,229 | B1 | 3/2002 | Shiraishi et al. |
| 6,395,443 | B2 | 5/2002 | Kuroda et al. |
| 6,403,275 | B1 | 6/2002 | Kuramoto et al. |
| 6,406,826 | B1 | 6/2002 | Suzuki et al. |
| 6,432,589 | B1 | 8/2002 | Uchinokura et al. |
| 6,442,364 | B2 | 8/2002 | Kai et al. |
| 6,468,706 | B2 | 10/2002 | Matsuda et al. |
| 6,505,014 | B2 | 1/2003 | Aoki et al. |
| 6,507,718 | B2 | 1/2003 | Ohjimi et al. |
| 6,699,632 | B2 * | 3/2004 | Higuchi et al. ..... 430/110.3 |

FOREIGN PATENT DOCUMENTS

| | | |
|---|---|---|
| EP | 0 872 774 | 10/1998 |
| EP | 0 926 563 | 6/1999 |
| EP | 1 168 089 | 1/2002 |

OTHER PUBLICATIONS

Patent Abstracts of Japan, JP 2000–075538, Mar. 14, 2000.
Chinese Office Action w/corresponding U.S. application 5,935,751.

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner including toner particles including a binder resin and a release agent, wherein when the toner is molded into a plate upon application of a pressure of 478 kg/cm$^2$, the toner plate has a surface having a coefficient of static friction of from 0.20 to 0.40. An image forming apparatus including an image bearing member, an image developer to form a toner image on the image bearing member, an image transferer configured to transfer the toner image on a receiving material and a fixer configured to fix the toner image thereon, wherein the apparatus has a waiting time not longer than 15 seconds, and a maximum power consumption not greater than 1.5 KW and 30 W in an image forming state and in a standby state, respectively, wherein the toner is the toner mentioned above.

4 Claims, 6 Drawing Sheets

TONER, METHOD FOR MANUFACTURING THE TONER, AND IMAGE FORMING METHOD AND APPARATUS USING THE TONER

This application is a division of application Ser. No. 09/965,826, filed Oct. 1, 2001.

BACKGROUND OF THE INVENTION

1. Field of the Invention

The present invention relates to a toner for developing an electrostatic latent image formed by electrophotography, electrostatic recording methods, electrostatic printing methods, etc. In addition, the present invention relates to a method for manufacturing the toner. Further, the present invention relates to an image forming method and apparatus using the toner.

2. Discussion of the Background

As for electrophotography, various methods have been disclosed, for example, in U.S. Pat. No. 2,297,691 and Japanese Patent Publications Nos. (hereinafter referred to as JPPs) 49-23910 and 43-24748. In these methods, a copy image is typically formed by the processes of forming an electrostatic latent image on a photoreceptor including a photosensitive material by one of various latent image forming methods; developing the latent image with a toner; transferring the toner image on a receiving material such as papers; and fixing the toner image thereon upon application of heat, pressure or a solvent vapor.

The methods for developing an electrostatic latent image are broadly classified into liquid developing methods using a liquid developer in which one or more of pigments or dyes are finely dispersed in an insulating organic liquid, and dry developing methods, such as cascade developing methods, magnetic brush developing methods and powder cloud developing methods, which use a dry developer including a toner in which a colorant such as carbon black is dispersed in a natural or synthetic resin. Currently, the dry developing methods are mainly used because dry developers are easier to handle than liquid developers.

As for fixing methods in electrophotography, heat roller fixing methods have been typically used because of having good energy efficiency. However, these heat roller fixing methods have a drawback in that a so-called offset phenomenon tends to occur such that when a toner image is fixed, part of the toner image adheres to a heat roller and the part of the toner image is re-transferred on a copy paper, resulting in formation of an undesired image.

In attempting to solve such an offset phenomenon, methods in which a release agent such as waxes is included in a toner have been disclosed. For, example, Japanese Laid-Open Patent Publications Nos. (hereinafter JOPS) 51-143333, 57-148752, 58-97056 and 60-247250 have disclosed to use solid silicone varnishes, higher fatty acids, higher alcohols, various waxes, etc., as a release agent.

However, when such a release agent is included in a toner, a filming problem tends to occur in that the release agent is separated from the toner when developing processes are performed and then the thus formed free release agent adheres to a photoreceptor and a developing sleeve. The thus formed film of the free release agent gradually grows when copying processes are repeated, resulting in formation of a white stripe image on a half tone image when the film becomes too thick. Therefore, it has been needed for a toner including a release agent to solve the offset phenomenon and filming problem at the same time. In other words, in order to produce images having good image qualities for along period of time, it has been needed to improve toners while paying attention to the release agent therein.

Currently, a need for high quality images increases more and more in the market. Satisfactory images cannot be produced by conventional toners, which typically have a volume average particle diameter of from 10 to 15 $\mu$m, and therefore a need exists for a toner having a smaller particle diameter. However, when the particle diameter of a toner becomes smaller, the release agent included in the toner is easily separated from the toner if the toner is subjected to stresses, etc. In particular, when the toner is prepared by a pulverization method, kneaded toner constituents tend to be divided at the position in which the release agent is present when pulverized, which typically has a sharp molecular weight distribution peak and is brittle, and thereby the release agent tends to be present on the surface of the resultant toner particles or tends to be present as fine powders in the resultant toner. Therefore, when a toner having a small particle diameter is used to produce high quality images, the filming problem tends to occur. In addition, another problem of poor fixing occurs. Namely, when a toner having a small particle diameter is used, the amount of the toner included in a half tone image formed on a receiving material decreases. In this case, the amount of heat applied from a heating member to the toner particles transferred on a recessed portion of the receiving material is very small, and therefore the toner image has poorly fixed particularly when fixed at a low temperature.

In addition, in order to save power consumption and reduce $CO_2$ emission, there are needs for image forming apparatus to reduce the waiting time (warm-up time), i.e., an interval between the time when the image forming apparatus is in an on state to the time when an image forming operation can be performed, and to minimize the energy consumed in the pre-heating state of the apparatus in which the fixing unit is preliminarily heated so as to be quickly heated to a temperature in the fixable temperature range when receiving a print order.

There is a technique procurement project for next-generation copiers in the DSM (Demand-side Management) program of the year 1999 of International Energy Agency, and requirements for the copiers are disclosed. As for the requirements for a copier having a copying speed not less than 30 cpm, the waiting time is not greater than 10 seconds and the power consumption in the waiting period (i.e., a period in which image forming operations are not performed) is from 10 to 30 W, which depends on the copying speed. Thus, there are stringent requirements for the next generation copiers to drastically reduce total electric power consumption and C02 emission.

A method in which a heat roller having a low heat capacity is used to improve its temperature sensitivity is considered to be useful for satisfying the requirements. However, the method is not satisfactory because in medium-speed to high-speed image forming apparatus, the amount of heat applied to toner images is very small.

In order to fulfill the above-mentioned requirements, i.e., to minimize the waiting time, it is considered that to lower the fixable temperature of the toner itself is needed.

When the level of low temperature fixing is discussed referring to the preset fixing temperature of the image forming apparatus, the image forming apparatus are needed to have a preset fixing temperature lower than the preset fixing temperature at which a current low fixable toner can be used. Therefore it is considered that a toner satisfying the requirements cannot be easily developed only by using known techniques.

In addition, when a toner having low temperature fixability is used, it is considered that to impart a wide fixable temperature range (i.e., a hot-offset resistance) and a good high temperature preservability to the toner become difficult.

In particular, when the image forming speed increases, the temperature of the heating member tends to decrease in fixing, resulting in decrease of the amount of heat used for fixing. Therefore, measures should be taken on both the toner and fixing device sides to improve low temperature fixability.

In attempting to solve these problems, various methods have been proposed. For example, JOP 5-173354 discloses a toner including a release agent, wherein the physical properties, addition amount and species of the release agent are specified. JOP 6-161144 discloses a toner including a release agent, wherein the shape of the release agent dispersed in the toner is specified. JOP 7-104500 (i.e., Japanese Patent No. 2,675,974) discloses a toner having a specific coefficient of dynamic friction and including an external additive treated with a polyalkylene and a silicone oil to improve the cleaning ability and durability of the toner.

JPP 8-3656 discloses a toner system including two different magnetic toners having different coefficients of dynamic friction. JOP 11-95477 discloses a toner including an external additive having a coefficient of dynamic friction of from 0.12 to 0.30 to improve the transferability of the toner and to avoid the filming problem. JOP 2000-105484 discloses a technique in which the coefficient of static friction of a toner image is specified to improve the fixability of the toner image. JOP 2000-310875 discloses a toner whose coefficient of friction is specified when the external additive of the toner is embedded into the toner by stresses. In addition, JOP 2001-5220 discloses four color toners for forming full color images, wherein the coefficients of dynamic friction are specified.

However, both the filming problem and the offset problem can be solved at the same time by these toners and methods. In particular, when the toners are subjected to mechanical stresses and heat stresses in image forming apparatus, the effects thereof are hardly exerted, i.e., the filming problem occurs when used for long period of time. Therefore, a need exists for a technique by which the filming problem and the offset problem can be avoided at the same time even when a toner is used for a long period.

In attempting to improve low temperature fixability of toner, several methods in which two different polyester resins having different properties are used in a toner have been proposed. For example, a method in which a non-linear polyester resin is used in combination with a linear polyester resin (JOP 60-90344); a method in which a crosslinkable polyester having a glass transition temperature (Tg) not lower than 50° C. and a softening point not higher than 200° C. is used in combination with a linear polyester resin having a softening point not higher than 150° C. and a weight average molecular weight (MW) of from 3,000 to 50,000 (JOP 64-15755); a method in which a non-linear polyester polymer having a weight average molecular weight not less than 5,000 and a variance ratio (MW/MN) not less than 20 is used in combination with a non-linear polyester polymer having a weight average molecular weight of from 1,000 to 5,000 and a variance ratio not less than 4 (JOP 2-82267); a method in which an organic metal compound including a linear polyester resin having an acid value of from 5 to 60 and a non-linear polyester resin having an acid value less than 5 is included in a toner (JOP 3-229264); a method in which a first saturated polyester resin is used in combination with a second saturated polyester resin having an acid value 1.5 or more times the acid value of the first polyester resin (JOP 3-41470); etc.

In these methods, it is intended to achieve a good combination of low temperature fixability and hot offset resistance by using a mixture of a non-crosslinkable resin with a crosslinkable resin. However, the blended resins have good compatibility (i.e., the resins can be mixed well with each other), and therefore the kneaded toner constituents cannot be easily pulverized, resulting in deterioration of productivity, and thereby the manufacturing costs increase.

In addition, toners in which a polyester resin having good fixability is mixed with a styrene-acrylic resin having good pulverizability have been disclosed in JOPs 49-6931 and 54-11424. However, since polyester resins typically have poor compatibility with styrene-acrylic resins, both the resins are unevenly dispersed in a toner when the resins are simply mixed mechanically. Therefore when a toner is prepared, a colorant such as carbon black and a charge controlling agent are poorly dispersed in the toner, resulting in occurrence of fouling in the background areas of the resultant toner images.

JOPs 4-142301 and 7-98517 have proposed methods in which a resin prepared by polymerizing a polyester resin with a styrene resin in a container is used for a toner to impart a good pulverizability to the toner and to uniformly disperse a colorant and a charge controlling agent in the resin. However, these toners have a narrower fixable temperature range than in the case in which a non-linear resin and a linear resin are used in combination. In attempting to solve this problem, JOP 8-320593 discloses a toner which includes a mixture of three different resins having different physical properties, i.e., different glass transition temperatures. When preparing this toner, toner constituents cannot be dispersed well because the resins are merely blended, and thereby problems occur such that background fouling is caused in the resultant images and in addition the toner image has poor blocking resistance.

As mentioned above, currently low temperature fixing are increasingly performed, and therefore a need exists for low temperature fixing technique. In addition, a need also exists for a miniaturized image forming apparatus. However, there is no toner which has a low temperature fixability and a wide fixable temperature range (i.e., good hot offset resistance) as well as good high temperature preservability and good pulverizability, and is capable of producing images having good image qualities without producing background fouling and the filming problem even when a low pressure fixing device is used.

Because of these reasons, a need exists for a toner fulfilling the requirements mentioned above. In addition, a need exists for an image forming method and apparatus, in which high quality toner images are produced for a long period of time without causing the filming problem and offset problem while electric power consumption and waiting period are reduced.

SUMMARY OF THE INVENTION

Accordingly, an object of the present invention is to provide a toner which can be used for a long period of time without forming toner film on an image bearing member, etc. and without causing a hot offset problem even when the toner is subjected to mechanical and heat stresses, and a method for manufacturing the toner.

Another object of the present invention is to provide a toner which can produce images having good fine line reproducibility without causing background fouling, and a method for manufacturing the toner.

Yet another object of the present invention is to provide a toner having a good low temperature fixability and good high temperature preservability, and a method for manufacturing the toner.

A further object of the present invention is to provide a toner which can produce good images even when used for a small-size image forming apparatus in which a toner replenishing mechanism and a toner concentration sensor are not provided, and a method for manufacturing the toner.

A still further object of the present invention is to provide an image forming method and apparatus by which good images can be produced at a low fixing temperature without causing a filming problem and a hot offset problem while electric power consumption and waiting period are reduced.

Briefly these objects and other objects of the present invention as hereinafter will become more readily apparent can be attained by a toner composition including toner particles, which particles include at least a binder resin and a release agent, wherein when the toner composition is pressed upon application of a pressure of 478 kg/cm$^2$ to form a toner plate, the toner plate has a surface having a coefficient of static friction of from 0.20 to 0.40.

The toner particles preferably have a volume average particle diameter (D4) of from 4.0 to 7.5 $\mu$m, and includes particles having a particle diameter not greater than 5.0 $\mu$m in an amount of from 60 to 80% by number.

The release agent is preferably a material selected from the group consisting of carnauba waxes, montan waxes and oxidized rice waxes, and is preferably present in the toner particles in an amount of from 2 to 10% by weight based on the binder resin in the toner particles.

When the release agent is dispersed in the binder resin, the release agent preferably has a volume average particle diameter of from 10 to 800 $\mu$m.

The binder resin preferably includes a non-linear polymer (A), a linear polymer (B) and a polymer (C) which is prepared by performing a condensation polymerization and addition polymerization at the same time in a container using a mixture of a condensation-polymerizable monomer and an addition-polymerizable monomer or performing a condensation polymerization and addition polymerization independently in a container using a mixture of a condensation-polymerizable monomer and an addition-polymerizable monomer.

Each of the polymers (A), (B) and (C) preferably has a polyester unit or a polyamide unit.

The toner composition may be a magnetic toner composition including a magnetic material.

In another aspect of the present invention, a method for manufacturing a toner composition including the steps of kneading a mixture including at least a non-linear polymer (A), a linear polymer (B), a polymer (C) and a release agent upon application of heat; cooling the kneaded mixture; pulverizing the mixture; and classifying the pulverized mixture to prepare toner particles, wherein the polymer (C) is prepared by performing a condensation polymerization and addition polymerization at the same time in a container using a mixture of a condensation-polymerizable monomer and an addition-polymerizable monomer or performing a condensation polymerization and addition polymerization independently in a container using a mixture of a condensation-polymerizable monomer and an addition-polymerizable monomer.

In yet another aspect of the present invention, an image forming apparatus is provided which includes an image bearing member configured to bear an electrostatic latent image thereon, an image developer configured to develop the latent image with a developer including a toner to form a toner image on the image bearing member, an image transferer configured to transfer the toner image onto a receiving material optionally via an intermediate transfer medium, and a fixer configured to fix the toner image on the receiving material., wherein the waiting time of the image forming apparatus is not longer than 15 seconds, and preferably not longer than 10 seconds; the maximum electric power consumption of the image forming apparatus is not greater than 1.5 KW when image forming operations are performed; and the maximum electric power consumption is not greater than 30 W when image forming operations are not performed, wherein the toner is the toner composition of the present invention.

The image forming apparatus preferably has a copy speed of 30 cpm/A-4 size.

The developer preferably includes a carrier and the toner composition. In addition, the image forming apparatus preferably includes a toner container including the toner composition to be replenished and/or a developer container including the toner composition and a carrier.

In a further aspect of the present invention, an image forming method is provided which includes steps of forming a toner image on a receiving material; and passing the receiving material through a nip between two fixing members upon application of heat and pressure thereto to fix the toner image on the receiving material, wherein the thickness of the fixing member contacting the toner image is not greater than 0.7 mm and the pressure (i.e., (load applied to the members)/(contacting area thereof)) applied to the two fixing members is not greater than $1.5\times10^5$ Pa.

In a still further aspect of the present invention, an image forming method is provided which includes steps of forming a toner image on a receiving material; and passing the receiving material through a nip between a fixing belt member which is heated by a fixed heater and a pressing member which presses the receiving material toward the heating belt member to fix the toner image on the receiving material, wherein the toner image is formed of the toner composition of the present invention.

In a still further aspect of the present invention, an image developer is provided which includes a developer bearing member having a magnetic field generating means therein and configured to bear a developer including a magnetic carrier and a magnetic toner composition including a binder, a release agent and a magnetic material, while rotating; a first regulation member configured to regulate the amount of the developer supplied to the developer bearing member to form a developer layer on the developer bearing member; a developer containing member configured to contain the developer regulated by the first regulating member; and a toner containing member located adjacent to the developer containing member and configured to supply the toner composition to the developer bearing member through an opening, wherein the image developer changes the amount of the toner supplied from the toner containing member according to information of a toner concentration in the developer layer on the developer bearing member, wherein the developer containing member includes a second regulating member which is located on an upstream side from the first regulating member relative to the rotating direction of the developer bearing member, and configured to scrape the developer layer when the toner concentration of the developer layer increases and the developer layer thickens to cover the opening with the scraped developer, and wherein the toner composition is the toner composition of the present invention.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
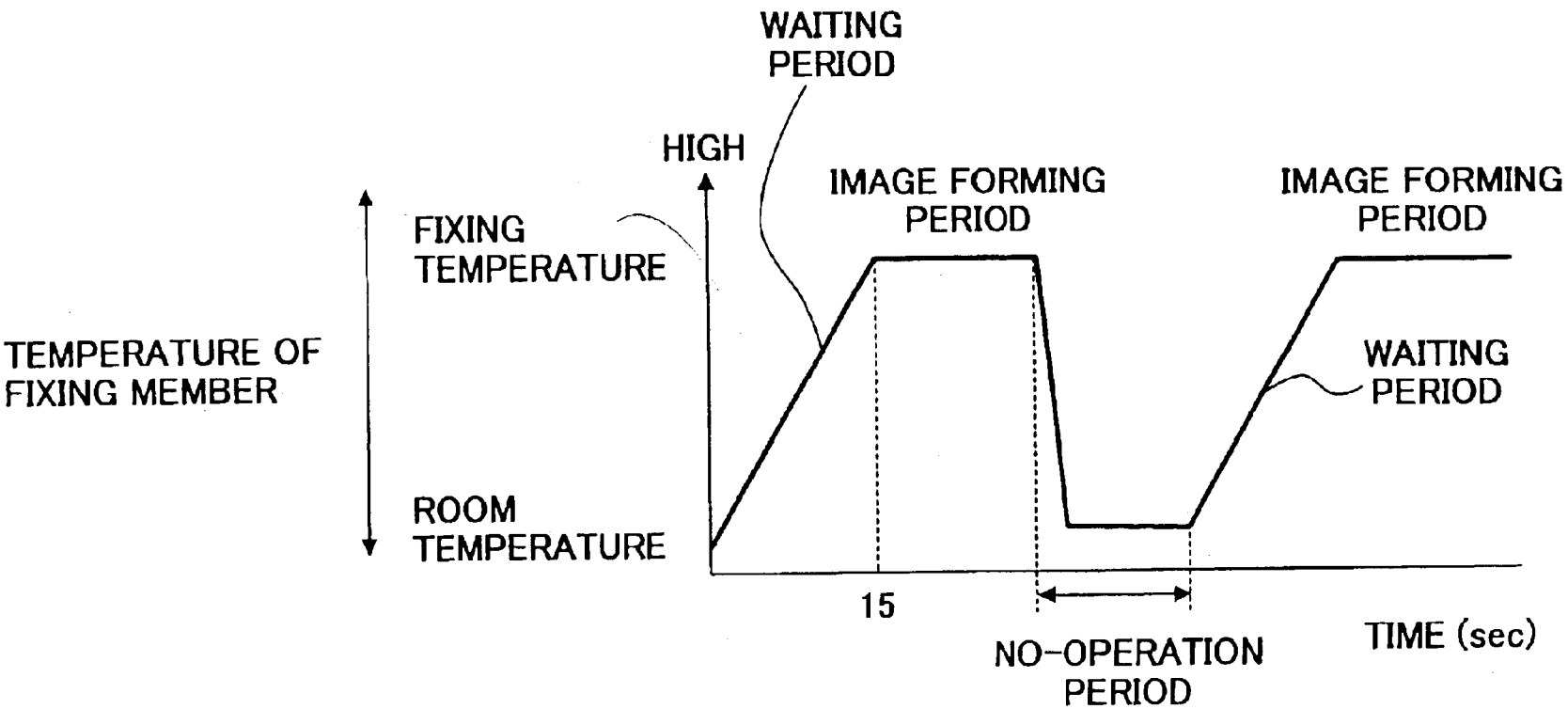
FIG. 1 is a graph illustrating changes of the temperature of the fixing member of an embodiment of the image forming apparatus of the present invention.

The present invention will be explained in detail.

The present inventors have been attempting to prevent the filming problem while paying attention to the release agent present on a surface of toner particles. In particular, the present inventors attempt to prevent the filming problem while taking consideration of the stresses applied to the toner in an image forming apparatus. As a result, it is found that by using a toner composition having a property such that when the toner composition is molded into a toner plate upon application of a pressure of 478 kg/cm$^2$, the toner plate has a surface having a coefficient of static friction of from 0.20 to 0.40, the filming problem can be avoided even when the stresses are applied to the toner.

In the present invention, the toner composition (hereinafter referred to as toner) means a composition that includes toner particles including at least a binder resin and a release agent, and one or more external additives. The coefficient of static friction is measured for a toner plate of the toner composition. The toner plate is formed by pressing the toner composition upon application of 6 tons per 12.56 cm$^2$ (i.e., 478 kg/cm$^2$) to form a toner plate.

The toner of the present invention is prepared by kneading a mixture including at least a binder resin and a release agent using a heat roll mill upon application of heat; cooling the kneaded mixture; pulverizing the mixture; classifying the pulverized mixture to form toner particles; and mixing an external additive with the toner particles using a Henshel mixer or the like.

The feature of the toner of the present invention is that when the toner is molded into a toner plate upon application of pressure of 478 kg/cm$^2$, the surface friction coefficient of the plate ranges from 0.20 to 0.40, preferably from 0.25 to 0.35, and more preferably from 0.30 to 0.35. The filming problem to be solved by the present invention is that a release agent included in a toner is transferred on the surface of a photoreceptor or a developing sleeve. In order to solve this filming problem, the amount of a release agent present on the surface of toner particles should be controlled.

In general, release agents have a low friction coefficient. The more the amount of a release agent present on the surface of a toner, the lower the friction coefficient of the surface of the toner. In addition, when an external additive of a toner, which serves as a spacer (i.e., covers the surface of the toner), is embedded in the toner due to physical stresses, the surface of the toner particles are exposed (i.e., the release agent is present on the surface of the toner), and thereby the friction coefficient of the surface of the toner particles lowers.

In the present invention, the friction coefficient of a toner is measured by the following method. At first, a toner is molded into a plate upon application of pressure. The surface of the toner plate is analyzed by a friction analyzer to determine the friction coefficient of the toner plate. When this measurement is performed (i.e., a pressure is applied to the toner), the toner is subjected to mechanical and heat stresses, which are similar to the stresses which the toner is subjected in an image forming apparatus, and therefore the release agent included in the toner tends to separate from the toner, resulting in migration of the release agent to the surface of the toner. Namely, the lower the friction coefficient of the toner plate, the more the amount of the release agent present on the surface of the toner. Therefore, by performing this measurement, it can be determined whether the toner is stable when repeatedly used.

When the friction coefficient of a toner including a release agent is not less than 0.20, i.e., when the amount of the release agent present on the surface of the toner is small, the filming problem can be prevented even when used for a long period of time.

In addition, when the friction coefficient is not greater than 0.4, the hot offset problem can be prevented because the release agent fully fulfills its function (i.e., exerts the releasability).

The friction coefficient of a toner including a release agent depends on the amount of the release agent present on the surface of the toner. The friction coefficient of a toner changes depending on whether the release agent is present on the surface of the toner when the toner is prepared by pulverizing a toner block and the adhesion conditions of the external additive on the toner. The amount of the release agent on the toner surface changes depending on the particle diameter of the release agent when the toner constituents including the release agent are kneaded, and pulverization conditions.

In general, release agents are more brittle than binder resins. Therefore, when a kneaded toner block including a release agent is pulverized, the toner block tends to be divided at the release agent portion and therefore the release agent tends to be present on the surface of the resultant toner particles. In addition, the release agent tends to be present as fine particles in the toner. Therefore, by making the diameter of the release agent to be dispersed in the toner block small (by changing the addition amount of the release agent, the particle diameter of the release agent added, compatibility of binder resins used, and kneading conditions such as shear strength applied in the kneading step), the amount of the release agent present on the toner particles can be decreased. In addition, since the friction coefficient of external additives is typically greater than that of release agents, the friction coefficient of a toner can be controlled by changing the coverage of the toner with an external additive and the adhesion conditions of the external additive.

The properties of a toner including a release agent largely change depending on the dispersing conditions of the release agent in the toner block. When a release agent is dispersed in a toner block while having a small dispersion diameter, the concentration of the release agent on the surface of the resultant toner particles is almost the same as that in the toner block. However, when a release agent is dispersed in a toner block while having a large dispersion diameter, the concentration of the release agent on the surface of the resultant toner particles is greater than that in the toner block. The reason is considered to be as follows.

When a kneaded toner block is pulverized, pulverization is typically performed using a mechanical impact force, an impact force using jet air, etc. When an external force is applied to a toner, the toner block is pulverized (divided) at weak portions (i.e., at the release agent portions). Therefore, when the release agent is present in the toner block while having a large dispersion diameter, the amount of the release agent on the surface of the resultant toner particles increase or fine release agent particles increase in the resultant toner particles. Therefore, such a toner tends to cause the filming problem. Such a toner has a low coefficient of dynamic friction. However, by controlling the frictional coefficient of a toner so as to fall in the above-mentioned range, the toner capable of producing high quality images without causing the filming problem and hot offset problem can be provided.

In the present invention, friction coefficient is measured using an automatic friction/abrasion analyzer DFPM-SS manufactured by Kyowa Interface Science Co., Ltd. By using this instrument and a stainless steel ball as a contact member, the coefficient of static friction of a toner (a toner plate) can be determined.

In addition, when the toner of the present invention has a particle diameter distribution such that the volume average particle diameter (D4) of the toner particles ranges from 4.0 to 7.5 μm and in addition particles having a particle diameter not greater than 5.0 μm are present in an amount of from 60 to 80% by number, the toner can produce images having good fine-line and half-tone reproducibility. Preferably the D4 is from 5.0 of 7.0 μm, and the content of the particles having a particle diameter not greater than 5.0 μm is from 65 to 75% by number. When a toner has such properties, not only high definition images can be produced, but also the filming problem, which is caused because a large amount of the release agent is present on the toner surface, can be prevented (i.e., the toner has good durability). A toner having such a desired particle diameter distribution can be prepared by controlling, for example, the following factors:

(1) The amount of the kneaded toner block to be pulverized supplied to a pulverizer;
(2) pressure and flow rate of high pressure air used for pulverizing the kneaded toner block;
(3) shape of a collision plate used for pulverizing the kneaded toner block;
(4) position from which air is supplied and air flowing direction in the air classifier used; and
(5) pressure of an exhaust fan in the air classifier used.

In the present invention, the volume average particle diameter (D4) and the content of particles having a particle diameter not greater than 5.0 μm are determined using a system including a Coulter Counter TA-II manufactured by Coulter Electronics, Inc., an interface (from Nikkaki-Bios Co., Ltd.) capable of outputting a number average particle diameter distribution and a volume average particle diameter, and a personal computer PC9801 from NEC Corp. As the electrolyte, 1% NaCl aqueous solution which is prepared using a sodium chloride of class 1 is used. The measuring method is as follows.

(1) 0.1 to 5 ml of a surfactant serving as a dispersant (preferably an alkylbenzenesulfonic acid salt) is added to 50 to 100 ml of the electrolyte mentioned above;
(2) 1 to 10 mg of a sample to be measured is added to the electrolyte including the surfactant;
(3) the mixture is dispersed for 1 minute using an ultrasonic dispersing machine;
(4) 100 to 200 ml of the electrolyte is contained in another container and the dispersion prepared above is added thereto such that the concentration of the sample is a predetermined value; and
(5) the particle diameter distribution of 30,000 particles having a particle diameter of from 2 to 40 μm of the sample is measured using Coulter Counter TA-II and an aperture of 100 μm to determine the volume and number particle diameter distributions of the particles.

The volume average particle diameter on a weight basis is determined by using the volume particle diameter distribution.

As the release agent for use in the toner of the present invention, known release agents can be used. Among the release agents, carnauba waxes, montan waxes and oxidized rice waxes are preferably used alone or in combination.

Suitable carnauba waxes include ones which have microcrystal, and an acid value not greater than 5. In addition, it is preferable that when carnauba wax is dispersed in a binder resin, the particle diameter of the carnauba wax is preferably not greater than 1 μm.

Montan waxes are montan-type waxes prepared by refining minerals. Suitable montan waxes include ones which have microcrystal, and an acid value of from 5 to 14 mgKOH/g.

Oxidized rice waxes are prepared by air-oxidizing rice waxes. Suitable oxidized rice waxes include ones which have an acid value of from 10 to 30 mgKOH/g.

Other known release agents such as solid silicone varnishes, higher fatty acids, higher alcohols, montan ester waxes, low-molecular-weight polypropylene waxes, etc. can be used in combination with the above-mentioned suitable release agents.

The content of the release agent in the toner is typically from 1 to 15 parts by weight, and preferably from 2 to 10 parts by weight, per 100 parts by weight of the binder resin included in the toner to control the amount of the release agent present on the surface of the toner, i.e., to prevent the filming and hot-offset problems. The amount of the release agent present on the surface of the toner (i.e., the dispersion diameter of the release agent in the toner block) can be controlled by changing addition amount of the release agent, shear strength applied to the toner constituents in kneading, and the kneading conditions such as kneading temperature.

In the present invention, the particle diameter of a release agent before the release agent is added to a binder resin is from 10 μm to 1 mm, and preferably from 10 to 800 μm to control the amount of the release agent present on the surface of the toner, i.e., to prevent the filming and hot-offset problems. The particle diameter of the release agent is measured by a laser diffraction/scattering particle diameter measuring instrument LA-920 manufactured by Horiba, Ltd.

As the binder resin for use in the toner of the present invention, known binder resins for use in the conventional toners can be used. However, it is preferable to use a combination of the following polymers (A), (B) and (C):

(A) a non-linear polymer;

(B) a linear polymer; and (C) a polymer (hereinafter sometimes referred to as a hybrid resin) which is prepared by performing a condensation polymerization and addition polymerization at the same time in a container using a mixture of a condensation-polymerizable monomer and an addition-polymerizable monomer, or performing a condensation polymerization and addition polymerization independently in a container using a mixture of a condensation-polymerizable monomer and an addition-polymerizable monomer.

In addition, it is preferable that the polymers (A), (B) and (C) have a polymer unit of the same kind. When such a binder resin is used, the dispersion of the release agent in the toner of the present invention can be further improved and therefore the filming problem can be prevented. In addition, the resultant toner has a wide fixable temperature range and good high temperature preservability (i.e., good blocking resistance), and can produce good images without background fouling.

A mixture including such binder resins and a release agent is kneaded upon application of heat, cooled, pulverized, and classified to prepare toner particles.

In order to prepare an improved low temperature fixable toner (i.e., to save fixing energy), it is preferable to use a combination of a linear polymer (B) having a low temperature fixability with a non-linear polymer (A) having good hot offset resistance, wherein the polymers (A) and (B) include a polymer of the same kind, because the polymers can be well dispersed in the resultant toner and the resultant toner has a wide fixable temperature range.

However, when a mixture of polymers having low temperature fixability is used, it is hard to pulverize the resultant toner block and therefore the toner has poor productivity because the polymers are soft and mixed well with each other. In addition, the resultant tone has poor high temperature preservability (i.e., poor blocking resistance).

In order to improve pulverizability, it has been attempted to use a combination of a resin having different compatibility with other two different resins (for example, a combination of a styrene-acrylic resin with a linear polyester and a non-linear polyester). However, in the resultant toner the release agent and colorant are poorly dispersed, resulting in formation of background fouling in the resultant images.

In contrast, in the present invention a hybrid resin (C) which includes a polymer unit of the same kind of the polymer unit included in the polymers (A) and (B) is added to the polymers (A) and (B). In such a toner, the hybrid resin (C) has a proper compatibility with the polymers (A) and (B), and therefore a toner which has a wide fixable temperature range and can produce good images without background fouling while having a good pulverizability and good high temperature preservability can be provided. When the polymers (A), (B) and (C) have a polymer unit of the same kind, the resultant toner has further improved high temperature preservability (blocking resistance) and can produce images further improved in view of background fouling.

The polymers (A), (B) and (C) preferably have a polyester unit or a polyamide unit, and more preferably have a polyester unit.

The contents of the non-linear polymer (A), linear polymer (B) and hybrid resin (C) in the toner are from 30 to 70 parts by weight, from 30 to 70 parts by weight and from 5 to 30 parts by weight, respectively, per 100 parts by weight of total weight of the polymers (A), (B) and (C).

In addition, it is preferable that the following relationships are satisfied because the resultant toner has a further wide fixable temperature range and better pulverizability.

$$Tm(A)>Tm(C)>Tm(B) \quad (1)$$

$$|Tg(A)-Tg(B)|<10\ (^\circ\ C.) \quad (2)$$

$$30\leqq Tm(A)-Tm(B)\leqq 60\ (^\circ\ C.) \quad (3)$$

wherein Tm(A), Tm(B) and Tm(C) represent softening points of the polymers (A), (B) and (C), respectively, and Tg(A) and Tg(B) represent glass transition temperatures of the polymers (A) and (B), respectively.

When the relationship (1) is satisfied, background fouling of the resultant images can be improved. The reason is considered to be that the non-linear polymer (A) and the linear polymer (B) are well dispersed by the hybrid polymer (C).

When the relationship (2) is satisfied, the binder resins can be mixed well in the kneading process and therefore the resins are dispersed well, resulting in improvement of background fouling. In the relationship (2), the value of |Tg(A)−Tg(B)| is preferably not greater than 7° C.

When the relationship (3) is satisfied, the resultant toner has a wide fixable temperature range. The difference (i.e., Tm(A)−Tm(B)) is preferably from 35 to 55° C.

In addition, when the non-linear polymer (A) has an acid value of from 20 to 70 mgKOH/g and/or the linear polymer (B) has an acid value of from 7 to 70 mgKOH/g, the resultant toner has good low temperature fixability and exhibits high stability to withstand environmental conditions. The reason is considered to be that the resins has affinity for receiving materials when the acid values of the polymers (A) and (B) are not less than 20 or 7 mgKOH/g, respectively, and therefore the toner can be fixed at a lower temperature. In addition, when the acid values of the polymers (A) and (B) are not greater than 70 mgKOH/g, the resultant toner can stably maintain a charge without being influenced by humidity changes. Therefore, images having high image density can be produced independently of environmental conditions.

In the present invention, by including a salicylic acid metal compound, which metal has a 3-valence or more, in the toner, the hot offset resistance can be improved because the metal salt reacts with the reactive portions of the resins and release agent, resulting in formation of a lightly-crosslinked structure.

When the metal has a 2-valence or less, the hot offset resistance cannot be improved because the reaction product has a two-dimensional structure. When the content of a salicylic acid metal compound in the toner is from 0.05 to 10 parts by weight per 100 parts by weight of the binder resin used, the effect for preventing the hot offset problem can be exerted. When the content is less than 0.05 parts by weight, the offset preventing effect cannot be exerted. To the contrary, when the content is greater than 10 parts by weight, low temperature fixability deteriorates although the hot offset resistance is further improved.

In addition, when the non-linear polymer (A) has a hydroxyl value not less than 20 mgKOH/g, the resultant toner has good hot offset resistance. The reason is considered to be that the hydroxyl groups of the non-linear polymer (A) react with a reactive portion of the salicylic acid metal complex, resulting in formation of a three-dimensional weak crosslinking network.

Next, toner constituents for use in the toner of the present invention will be explained in detail.

Suitable polymers for use in the polymers (A), (B) and (C) include polymers prepared by condensation polymerization, such as polyesters and polyamides, polymers prepared by addition polymerization, such as styrene-acrylic copolymers and styrene-butadiene copolymers. However, the polymers (A), (B) and (C) are not limited thereto, and any known polymers which are prepared by condensation polymerization or addition polymerization can be used.

Specific examples of the polymers prepared by condensation polymerization include polyester resins, polyester-polyamide resins, polyamide resins, etc. Suitable polyester resins for use in the toner of the present invention include polymers prepared by condensation-polymerizing a polyhydric hydroxyl compound with a polybasic acid. Specific examples of the polyhydric hydroxyl compounds include glycols such as ethylene glycol, diethylene glycol, triethylene glycol and propylene glycol; alicyclic compounds having two hydroxyl groups such as 1,4-bis(hydroxymethyl) cyclohexane; dihydric phenol compounds such as bisphenol A; etc. In addition, compounds having three or more hydroxyl groups can also be used as the polyhydric hydroxyl compound.

Specific examples of the polybasic acids include dibasic acids such as maleic acid, fumaric acid, phthalic acid, isophthalic acid, terephthalic acid, succinic acid and malonic acid; polybasic carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid; etc.

Suitable monomers for use in the polyester-polyamide resins and polyamide resins include polyamines such as ethylenediamine, pentamethylenediamine, hexamethylenediamine, phenylenediamine and triethylenetetramine; aminocarboxylic acids such as 6-aminocaproic acid and ε-caprolactam; etc. The polyester-polyamide resins and polyamide resins for use in the present invention preferably have a glass transition temperature not lower than 55° C., and more preferably not lower than 57° C.

Suitable polymers prepared by addition polymerization for use in the toner of the present invention include vinyl resins prepared by radical polymerization, but are not limited thereto. Specific examples of the monomers for use in the polymers prepared by addition polymerization include styrene type monomers such as styrene, o-methylstyrene, m-methylstyrene, p-methylstyrene, α-methylstyrene, p-ethylstyrene, vinylnaphthalene; ethylene type unsaturated mono-olefins such as ethylene, propylene, butylene and isobutylene; vinyl esters such as vinyl chloride, vinyl bromide, vinyl acetate and vinyl formate; ethylene type monocarboxylic acids and their esters such as acrylic acid, methyl acrylate, ethyl acrylate, n-propyl acrylate, isopropyl acrylate, tert-butyl acrylate, amyl acrylate, methacrylic acid, methyl methacrylate, ethyl methacrylate, n-propyl methacrylate, isopropyl methacrylate, tert-butyl methacrylate, amyl methacrylate, stearyl methacrylate, methoxy ethyl methacrylate, glycidyl methacrylate, phenyl methacrylate, dimethylaminoethyl methacrylate and diethylaminoethyl methacrylate; ethylene type monocarboxylic acid substitution compounds such as acrylonitrile, methacrylonitrile and acrylamide; ethylene type dicarboxylic acids and their substitution compounds such as dimethyl maleate; and vinyl ketones such as vinyl methyl ketone.

In addition, a crosslinking agent can be added when addition polymerization is performed. Specific examples of the crosslinking agents for use in the addition polymerization include known crosslinking agents such as divinyl benzene, divinyl naphthalene, polyethyleneglycol dimethacrylate, diethyleneglycol dimethacrylate, triethyleneglycol diacrylate, diprophleneglycol dimethacryalte, polypropyleneglycol dimethacrylate, and diallyl phthalate.

The addition amount of the crosslinking agent is 0.05 to 15 parts by weight, and preferably from 0.1 to 10 parts by weight, per 100 parts by weight of monomers used. When the addition amount of the crosslinking agent is less than 0.05 parts by weight, the effect of the crosslinking agent cannot be exerted. when the addition amount is greater than 15 parts by weight, the resultant resin cannot be melted even upon application of heat, and therefore the resultant toner produces poorly fixed images when the toner images are fixed upon application of heat.

When an addition-polymerizable monomer is polymerized, a polymerization initiator is typically used. For example, azo type or diazo type initiators such as 2,2-azobis (2,4-dimethylvaleronitrile) and 2,2-azobisisobutylonitrile, or peroxide polymerization initiators such as benzoyl peroxide, methyl ethyl ketone peroxide and 2,4-dichlorobenzoyl peroxide, etc., can be used. These initiators can be used in combination to control the molecular weight and molecular weight distribution of the resultant polymer. The addition amount of the initiator is from 0.05 to 15 parts by weight, and more preferably from 0.5 to 10 parts by weight, per 100 parts by weight of the monomer used.

In the condensation polymerization and addition polymerization mentioned above, the resultant polymers have a non-linear structure or a linear structure depending on the monomer or monomers used. In the present invention, both a non-linear polymer (A) and a linear polymer (B) are used.

In the present invention, the non-linear polymer means a polymer having a crosslinked structure, and the linear polymer means a polymer having substantially no crosslinked structure. Polymers having a crosslinked structure can be prepared for example, by performing polymerization using a monomer having three or more reactive groups.

In the present invention, in order to prepare the hybrid resin (C) in which a condensation-polymerized resin is chemically bonded with an addition-polymerized resin, it is preferable to perform polymerization in a container using monomers for the condensation-polymerized resin and the addition-polymerized resin and a double-reactive monomer which can react with the monomers for the condensation-polymerized resin and the addition-polymerized resin. Specific examples of such double-reactive monomers include fumaric acid, acrylic acid, methacrylic acid, maleic acid, dimethyl fumarate, etc.

The addition amount of the double-reactive monomer is from 1 to 25 parts by weight, and preferably from 2 to 10 parts by weight, per 100 parts by weight of the monomers used. When the addition amount is less than 1 part by weight, the dispersion of the colorant and charge control agent in the toner deteriorates, and thereby the image qualities deteriorate (for example, background fouling occurs). When the addition amount is greater than 25 parts by weight, the resin tends to gelate.

When this polymerization is performed in a container, proceeding or completion of both reactions (i.e., condensation polymerization reaction and addition polymerization reaction) can be performed at the same time (i.e., parallel reaction). In addition, it is possible to independently perform the reactions by properly setting the reaction temperature and/or reaction time.

For example, the polymerization of the hybrid resin (C) is performed as follows. A mixture of condensation-polymerizable monomers for a polyester resin is contained in a container, and then a mixture of addition-polymerizable monomers for a vinyl resin and a polymerization initiator is added thereto drop by drop to firstly complete the radical polymerization reaction of the addition-polymerizable monomers for the vinyl resin. Then the temperature of the mixture is increased to complete the condensation polymerization reaction, resulting in formation of the polyester resin. By performing the two different polymerizations independently in a container, the two different resins can be effectively dispersed.

In the toner of the present invention, a resin other than the above-mentioned resins can be used as a binder resin in combination with the above-mentioned resins in an addition amount such that the resin does not deteriorate the toner properties. Specific examples of such a resin include the following, but are not limited thereto.

Polyurethane resins, silicone resins, ketone resins, petroleum resins, hydrogenated petroleum resins, etc. These resins can be used alone or in combination. The method for manufacturing these resins is not particularly limited, and any known polymerization methods such as bulk polymerization, solution polymerization, emulsion polymerization, and suspension polymerization can be used.

The salicylic acid metal compound for use in the present invention has the following formula (1):

(1)

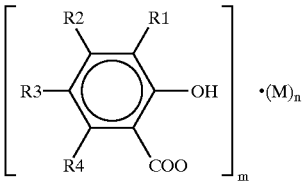

wherein R1, R2, R3 and R4 independently represent a hydrogen atom, an alkyl group having 1 to 18 carbon atoms or an allyl group, wherein R1 and R2, R2 and R3, or R3 and R4 optionally share bond connectivity to form an aromatic or aliphatic group optionally having a substituent; M represents a metal; and m is an integer not less than 3 and n is an integer not less than 2.

All metals can be used as the center metal M. Among the metals, Fe, Ni, Al, Ti, and Zr are preferable, and Fe is the most preferable in view of safety.

By using the above-mentioned resins (A), (B) and (C) and a salicylic metal compound, the offset resistance of the resultant toner can be improved. When the center metal M has 2-valence or less, the offset resistance cannot be improved.

The toner of the present invention can include a colorant, a magnetic material, a charge controlling agent, an additive, etc. if desired.

Specific examples of the colorant include known dyes and pigments such as carbon black, lamp black, iron black, Aniline Blue, Phthalocyanine Blue, Phthalocyanine Green, Hansa Yellow G, Rhodamine 6C Lake, chalco-oil blue, Chrome Yellow, quinacridone, Benzidine Yellow, Rose Bengale and triarylmethane. These dyes and pigments can be used alone or in combination. The toner of the present invention can be used as a black toner or a color toner. The content of the colorant in the toner is from 1 to 30% by weight, and preferably from 3 to 20% by weight, based on total resin components in the toner.

By including a magnetic material in the toner of the present invention, the toner can be used as a magnetic toner. Specific examples of the magnetic materials include iron oxides such as magnetite, hematite and ferrite; metals such as iron, cobalt and nickel; metal alloys of iron, cobalt or nickel with one or more of metals such as aluminum, copper, lead, magnesium, tin, zinc, antimony, beryllium, bismuth, cadmium, calcium, manganese, selenium, titanium, tungsten and vanadium; mixture of these materials; etc.

When these ferromagnetic materials are included in the toner of the present invention, the average particle diameter thereof is preferably from 0.1 to 2 $\mu$m. The content thereof in the toner is from about 20 to about 200 parts by weight, and preferably from 40 to 150 parts by weight, per 100 parts by weight of total resin components in the toner.

Suitable charge controlling agents for use in the toner of the present invention include known polarity controlling agents such as Nigrosine dyes, metal complex dyes and quaternary ammonium salts. The polarity controlling agents can be used alone or in combination. Suitable negative charge controlling agents include metal complexes of monoazo dyes, salicylic acid and dicarboxylic acids. The content of such polarity controlling agents in the toner is from 0.1 to 10 parts by weight, and preferably from 1 to 5 parts by weight, per 100 parts by weight of the resin components in the toner.

In the toner of the present invention, known inorganic fillers can be added as an external additive to the toner particles. It is preferable to add at least two different inorganic fillers.

The external additive is preferably added such that the surface of toner particles are covered at a coverage not less than 20%. It is considered that by adding an external additive in such an amount, the release agent present on the surface of a toner can be covered by the external additive to some extent, or a thin film of the release agent adhered on the surface of a photoreceptor or a developing sleeve can be scraped by the external additive. Thus, to add an external additive assists in exerting the effects of the toner of the present invention. In the present invention, the coverage is measured as follows:

(1) the surface of a toner is observed with a field emission scanning electron microscope (FE-SEM) and photographed;

(2) the image of the photograph is analyzed to determine the ratio (i.e. the coverage) of a surface area of the toner particles on which the external additive adheres to the total surface area of the toner particles in the photograph.

Specific examples of the inorganic fillers for use as the external additive include silica, alumina, titanium oxide, barium titanate, magnesium titanate, calcium titanate, strontium titanate, iron oxide, copper oxide, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, silicon nitride, etc. In the present invention, it is preferable to use a combination of a silica with a titanium oxide as the external additive because the resultant toner has proper abrading ability, which is advantageous to prevent the filming problem, and the combination can impart good charge stability to the toner.

In the present invention, it is preferable to use two different inorganic fillers having different average primary particle diameters. It is known that external additives are embedded into toner particles when stresses are applied thereto in a developing process. When two different inorganic fillers having different particle diameters are used, the larger filler serves as a spacer when the toner particles contact the surface of a photoreceptor and/or a toner carrier, and therefore the smaller filler is prevented from being embedded into the toner. Therefore, the initial surface conditions of the toner can be maintained for a long period of time, resulting in maintenance of the filming problem preventing effect.

When two different inorganic fillers are used, the inorganic filler having a smaller average primary particle diameter should be added in an amount greater than that of the inorganic filler having a larger average primary particle diameter. In this case, the properties of the resultant toner hardly change even when the toner is used for a long period of time. This is because the larger filler tends to be gradually embedded into the toner at first while the smaller filler stays on the surface of the toner.

One of the two different inorganic fillers preferably has an average primary particle diameter not greater than 0.03 μm to impart good fluidity to the resultant toner. When such a filler is added, the resultant toner has good fluidity, and therefore the toner can be uniformly charged, resulting in prevention of toner scattering and background fouling.

Another filler preferably has an average primary particle diameter not greater than 0.2 μm. As mentioned above, a filler having a particle diameter not greater than 0.03 μm imparts good fluidity to the resultant toner. In this case, when a filler having a particle diameter not greater than 0.2 μm is used in combination, the fluidity is further enhanced, and thereby the toner is more uniformly charged.

At least one of the two different inorganic fillers is preferably a hydrophobized inorganic filler which is treated with an organic silane compound because the resultant toner exhibits high stability to withstand environmental conditions, and in addition can produce high quality images without image defects such as omissions in character images. Needless to say, both the two different inorganic fillers may be hydrophobized.

Specific examples of hydrophobizing agent include organic silane compounds such as dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyltris(β-methoxyethoxy) silane, γ-mehacryloxypropyltrimethoxysilane, vinyltriacetoxysilane, divinyldichlorosilane, dimethylvinylchlorosilane, octyltrichlorosilane, decyltrichlorosilane, nonyltrichlorosilane, (4-tert-propylphenyl)trichlorosilane, (4-tert-butylphenyl) trichlorosilane, dipentyldichlorosilane, dihexyldichlorosilane, dioctyldichlorosilane, dinonyldichlorosilane, didecyldichlorosilane, didodecyldichlorosilane, dihexadecyldichlorosilane, (4-tert-butylphenyl) octyldichlorosilane, dioctyldichlorosilane, didecenyldichlorosilane, dinonenyldichlorosilane, di-2-ethylhexyldichlorosilane, di-3,3-dimethylpentyldichlorosilane, trihexylchlorosilane, trioctylchlorosilane, tridecylchlorosilane, dioctylmethylchlorosilane, octyldimethylchlorosiolane, (4-tert-propylphenyl)diethylchlorosilane, isobutyltrimethoxysilane, methyltrimethoxysilane, octyltrimethoxysilane, trimethoxy(3,3,3-trifluoropropyl) silane, hexamethyldisilazane, hexaethyldisilazane, diethyltetramethyldisilazane, hexaphenyldisilazane and hexatolyldisilazane; silicone oils such as dimethylsilicone oil, methylphenylsilicone oil, chlorophenylsilicone oil, methylhydrogensilicone oil, alkyl-modified silicone oils, fluorine-modified silicone oils, polyether-modified silicone oils, alcohol-modified silicone oils, amino-modified silicone oils, epoxy-modified silicone oils, epoxy/polyether-modified silicone oils, phenol-modified silicone oils, carboxyl-modified silicone oils, mercapto-modified silicone oils, acrylic-modified silicone oils, methacrylic-modified silicone oils, and α-methylstyrene-modified silicone oils; silylation agents; silane coupling agents having an alkyl fluoride group; organic titanate coupling agents; aluminum coupling agents; etc. Among these compounds, organic silane compounds are preferably used.

By treating the inorganic fillers mentioned above with one or more of these hydrophobizing agents, hydrophobic inorganic fillers for use as an external additive of the toner of the present invention can be prepared.

Specific examples of the hydrophobized silica, which have been marketed, include HDK H 2000, HDK H 2000/4, HDK H 2050EP, and HVK21 (which are manufactured by Hoechst AG); R932, R974, RX200, RY200, R202, R805, and R812 (which are manufactured by Nippon Aerosil Co.); and TS530 and TS720 (which are manufactured by Cabot Corp).

Suitable titanium oxides for use as the hydrophobized titanium oxide include crystalline titanium oxides having an anatase crystal form or a rutile crystal form or amorphous titanium oxides. Specific examples of the hydrophobized titanium oxides, which have been marketed, include T-805 (Nippon Aerosil Co.); MT150AI and MT150AFM (which has a rutile crystal form and are manufactured by Tayca Corp.); STT-30A (rutile crystal form) and STT-30A-FS (which are manufactured by Titan Kogyo K.K.); etc.

The particle diameter of the inorganic fillers for use in the present toner is measured using a particle diameter distribution measuring instrument utilizing dynamic light scattering, such as DLS-700 manufactured by Otsuka Electronics Co. Ltd. or Coulter N4 manufactured by Coulter Electronics Inc. It is hard to dissociate an aggregated organic silane compound which has been subjected to a hydrophobizing treatment. Therefore, it is preferable to measure the particle diameter of such a hydrophobized filler using a scanning electron microscope or a transmission electron microscope. In this case, measurements should be performed for at least 100 particles and the average value of the major diameters should be determined.

In another aspect of the present invention, two-component developer including the toner of the present invention and a carrier is provided. Suitable carriers for use in the present invention include known carriers. For example, magnetic powders such as iron powders, ferrite powders and nickel powders; glass beads; etc. can be used. The surface of such carrier materials may be treated with a resin, etc.

Suitable resins useful for coating carriers include styrene-acrylic copolymers, silicone resins, maleic acid resins, fluorine-containing resins, polyester resins, epoxy resins, etc. When styrene-acrylic copolymers are used, the fraction of styrene is preferably from 30 to 90% by weight. When the fraction of styrene is less than 30% by weight, the resultant developer has poor developing properties. In contrast, when the fraction is greater than 90% by weight, the coated film is hard and therefore tends to be easily peeled from the carrier material, resulting in shortening of life of the carrier.

When a carrier is coated with a resin, additives such as adhesion imparting agents, hardeners, lubricants, electroconductive agents, and charge controlling agents may be added to the resin.

Next, the image forming apparatus of the present invention will be explained in detail.

Figure 2:
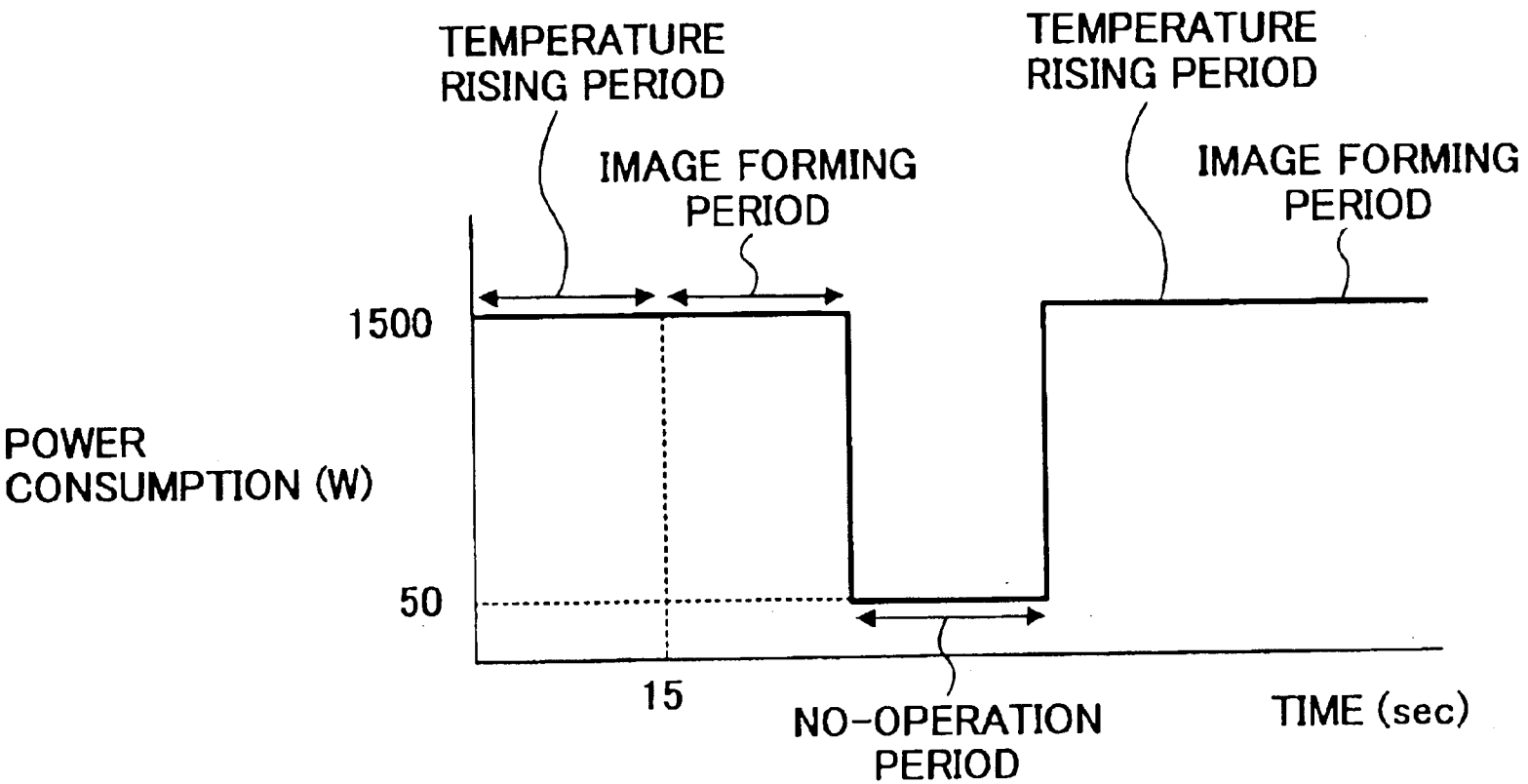
FIG. 2 is a graph illustrating changes of the electric power consumption of the above embodiment of the image forming apparatus of the present invention.

FIG. 1 is a graph illustrating changes of the temperature of a fixing member for use in the image forming apparatus of the present invention with lapse of time, and the changes of the electric power consumption of the image forming apparatus are illustrated in FIG. 2.

In general, when image forming operation is not performed (i.e., in a no-operation period), the temperature of a fixing member is lower than that the fixing temperature to minimize the power consumption of the image forming apparatus. The temperature of the fixing element is lowest just after electric power is applied to the image forming apparatus because pre-heating is not performed. Therefore, it is needed to wait for a period (a waiting period) until an image is printed out (i.e., until the temperature reaches the fixing temperature). The temperature of the fixing element changes as shown in FIG. 1. After the printing operations are completed, power is not supplied to the fixing element, and therefore the temperature of the fixing element gradually decreases (i.e., the fixing device achieves a waiting state). When an order to print out an image is made again, the cycle of waiting and printing-out is repeated. The electric power consumption of the image forming apparatus which is operated as shown in FIG. 1 is shown in FIG. 2. The total power consumption is obtained by integrating electric power consumption with a time. It is effective for energy saving to shorten the waiting period.

FIGS. 3–6 are schematic views illustrating the main parts of embodiments of the fixing device of the image forming apparatus of the present invention.

The image forming method and apparatus of the present invention will be explained in detail referring to the drawings.

Figure 3:
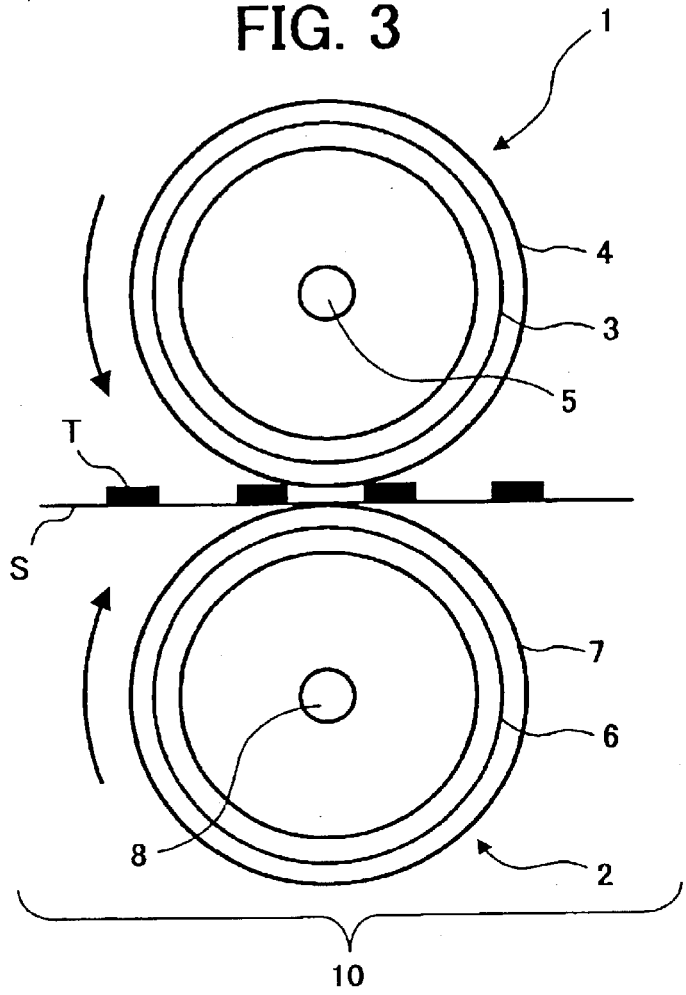
FIGS. 3 to 6 are schematic views illustrating embodiments of the fixing device of the image forming apparatus of the present invention.

One of the fixing method in the image forming method of the present invention is to fix a toner image held on a support upon application of heat by passing the support through a nip between two fixing members which are heated. As the fixing members, rollers and films can be used. For example, the structure of a fixing device using two rollers is shown in FIG. 3. In FIG. 3, numerals 10, 1 and 2 denote a fixing device, a fixing roller and a pressure roller, respectively. The fixing roller 1 has a metal cylinder 3 made of a good heat conductive material such as aluminum, iron, stainless steel or brass, and an offset preventing layer 4 which is formed on the surface of the metal cylinder 3. The offset preventing layer 4 is typically made of a material such as RTV, silicone rubbers, tetrafluoroethyleneperfluoroalkylvinylether (PFA), or polytetrafluoroethylene (PTFE).

A heat lamp 5 is arranged inside the metal cylinder 3. The pressure roller 2 has a metal cylinder 6, which is typically made of the same metal as that of the metal cylinder 3. On the surface of the metal cylinder 7, an offset preventing layer 7, which is made of a material such as PFA and PTFE, is formed. Optionally, a heat lamp 8 is arranged inside the pressure roller. The fixing roller 1 and the pressure roller 2 rotate while being pressed to each other by springs (not shown) provided on both ends thereof. A support S, such as paper, having a toner image T is passed through a nip between the fixing roller 1 and the pressure roller 2, and thereby the toner image T is fixed on the support.

In the fixing device for use in the present invention, the metal cylinder 3 of the fixing roller 1 has a thickness not greater than 0.7 mm. By using such a metal cylinder, the temperature rising property of the fixing roller 1 can be improved, and the temperature of the fixing roller 1 can be rapidly raised to the predetermined temperature. The thickness of the metal cylinder 3 is determined depending on the mechanical strength and heat conductivity of the material used, but thickness is preferably from 0.2 to 5 mm. In addition, the pressure (surface pressure) applied between the fixing roller 1 and the pressure roller is preferable not less than $1.5\times10^5$ Pa. The surface pressure is defined as L/A, wherein L represents a load applied to the both ends of the two rollers and A represents a contact area of the two rollers. The contact area can be measured as follows:

(1) a sheet such as OHP (overhead projection) sheets, which changes its surface conditions upon application of heat, is passed through a nip between the two rollers heated;
(2) the sheet is suddenly stopped while being nipped by the two rollers;
(3) after the sheet is nipped for tens second, the sheet discharged from the two rollers; and
(4) the area of the changed portion of the sheet is measured, which is the contact area.

To increase the surface pressure is advantageous for fixing toner images. However, when the surface pressure is increased in the fixing device in which the metal cylinders have a thickness not greater than 0.7 mm, the roller tends to be deformed, resulting in occurrence of problems such as wrinkling and jamming of transfer sheets. Therefore, a large pressure cannot be applied, and the pressure is preferably not greater than $1.5\times10^5$ Pa, and more preferably from 0.4 to $1.0\times10^5$ Pa.

By using a fixing device having such a construction as mentioned above, the toner image, which is made of the toner of the present invention having good high temperature preservability, can be fixed at a low temperature even when the waiting period is short. The present inventors discover that the reasons why the toner of the present invention has good fixbility even when used for such a fixing device having a low surface pressure are that the toner particles are embedded into a receiving paper (i.e., anchor effect), and in addition the toner particles are strongly bound with each other when heated due to high cohesive force of the toner particles. Thus, it is discovered that fine toner particles are preferable for preparing a strongly fixed toner image.

Figure 4:
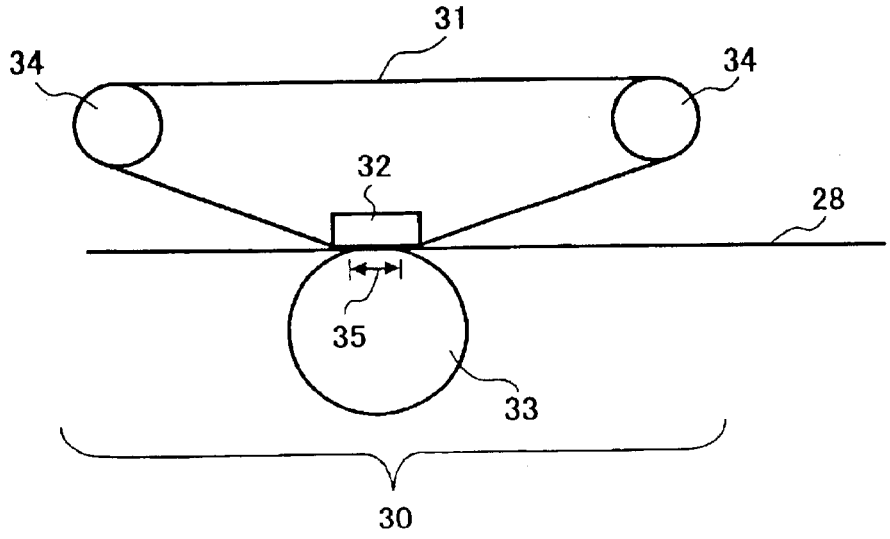

FIG. 4 illustrates an embodiment of the fixing device having one heating member for use in the present invention.

In the fixing device as shown in FIG. 4, a belt heating member 31 serves as the heating member. The belt heating member 31 is pressed by a pressing member 33 toward a fixed heater 32. In addition, the belt heating member 31 is tightened by tension applying members 34. A recording material 28 is passed through a contact heating region 35 formed by the belt heating member 31 and the pressing member 33, by a feeding member (not shown). A toner image on the recording material is fixed at the contact heating region 35 upon application of heat and pressure. At this point, the toner image is formed on the side of the recording material 28 contacting the belt heating member 31.

Figure 5:
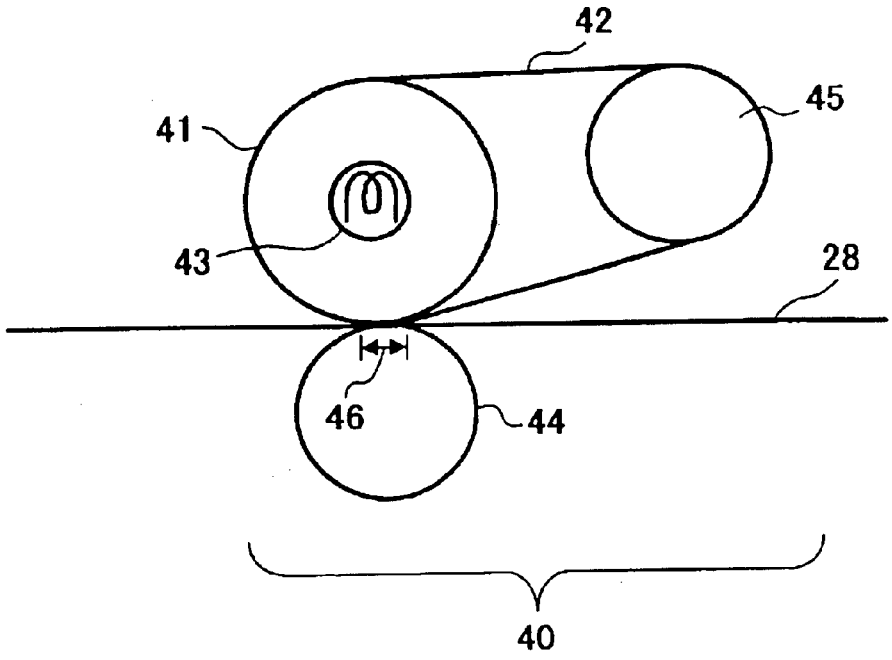

FIG. 5 illustrates another embodiment of the fixing device having two heating members for use in the present invention. In this case, a contact heating region is mainly formed by the pressure of a pressing member.

A fixing device 40 has a hollow cylinder-shaped heating member 41 and a belt-shaped heating member 42 as the heating members. Inside the cylinder heating member 41, a heater 43 is arranged. The belt heating member 42 is pressed by a pressing member 44 toward the roller heating member 41. In addition, the belt heating member 42 is tightened by rotatable roller-shaped tension applying member 45. A recording material 28 is fed by a feeding member (not shown) toward a contact heating region 46 formed between the belt heating member 42 and the pressing member 44. A toner image on the recording material 28 is fixed at the contact heating region 46 upon application of heat and pressure. At this point, the toner image is formed on the side of the recording material 28 contacting the belt heating member 42.

Figure 6:
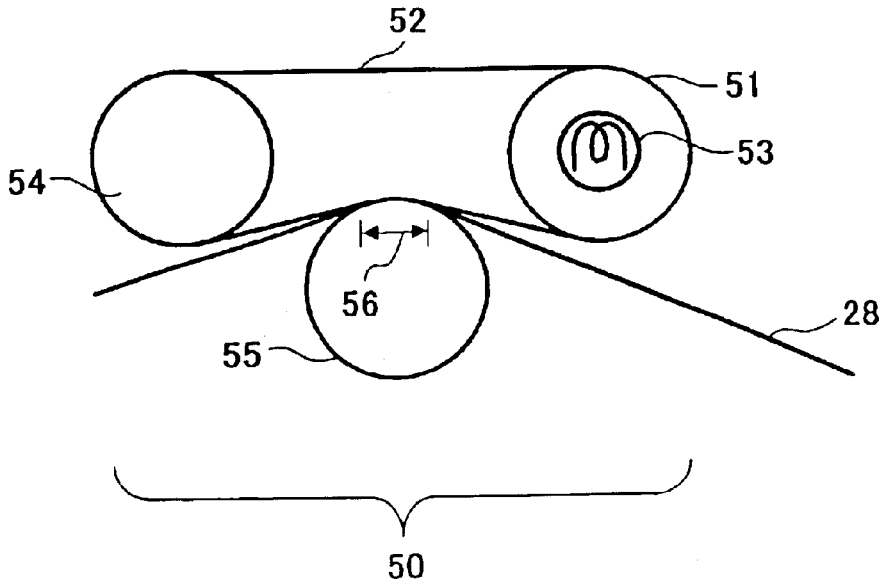

FIG. 6 illustrates another embodiment of the fixing device having two heating members for use in the present invention. In this case, a contact heating region is mainly formed by the tension of a belt heating member.

A fixing device 50 has a hollow-cylinder-shaped heating member 51 and a belt-shaped heating member 52 as the heating members. Inside the roller heating member 51, a heater 53 is arranged. The belt heating member 52 is tightened by a rotatable roller-shaped tension applying member 54 and pressed by a pressing member 55 to form a contact heating region 56. A recording material 28 is fed by a feeding member (not shown) toward the contact heating region 56 formed between the belt heating member 52 and the pressing member 55. A toner image on the recording material 28 is fixed at the contact heating region 56 upon application of heat and pressure. At this point, the toner image is formed on the side of the recording material 28 contacting the belt heating member 52.

In addition, these fixing devices may have a release agent applying mechanism which applies a release oil on the heating members to avoid or assist in avoiding the offset problem.

In the image forming apparatus of the present invention, the waiting period (i.e., a time from powering-up to a time when an image forming operation can be started) not longer than 15 seconds, and preferably not longer than 10 seconds. In addition, the total power consumption when image forming operations are performed is not greater than 1.5 KW, and the total power consumption when image forming operations are not performed is not greater than 30 W. In particular, when the toner of the present invention is used for an image forming apparatus capable of producing 30 or more A-4 size copy sheets per 1 minute, the toner images can be fixed at a low temperature and thereby the total power consumption can be reduced.

In other aspects of the present invention, a toner container containing the toner of the present invention; an image forming apparatus having the toner container; a developer container containing a two-component developer including the toner of the present invention and a carrier; and an image forming apparatus having the developer container are provided.

Next, the developing device for use in the present invention will be explained.

Figure 7:
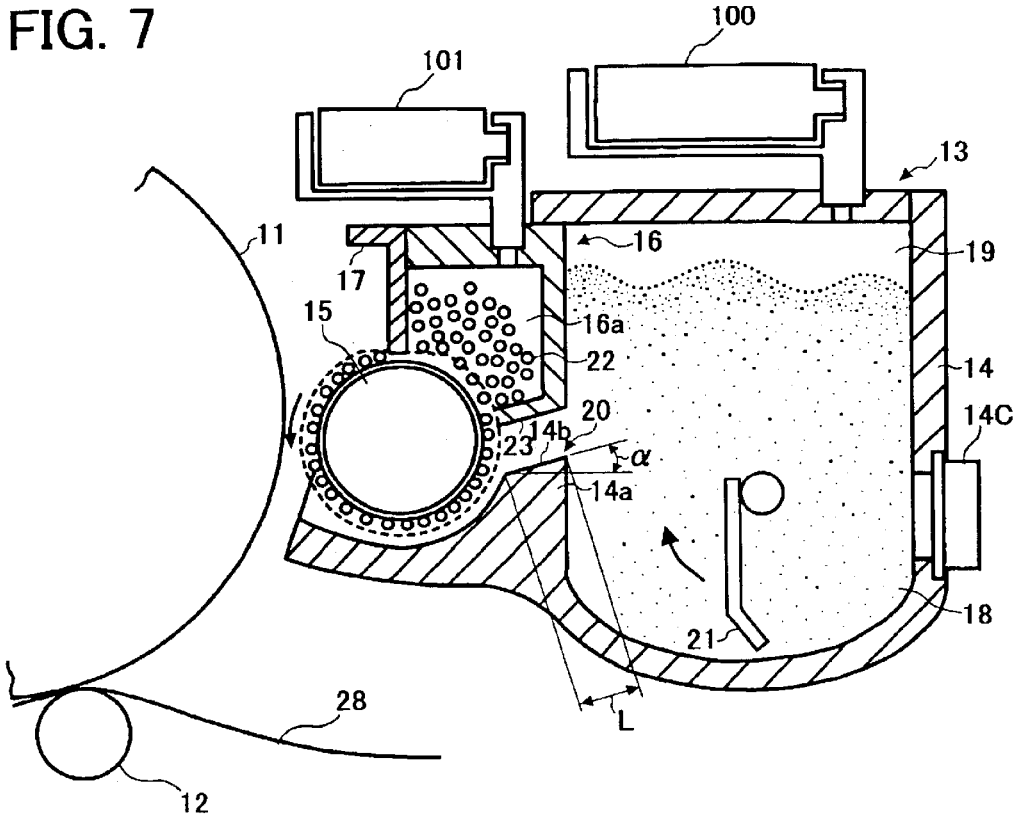
FIG. 7 is a schematic view illustrating an embodiment of the image developer of the image forming apparatus of the present invention.

FIG. 7 is a schematic view illustrating the developing section of an embodiment of the image forming apparatus of the present invention.

A developing device 13 arranged beside a photoreceptor drum 11 includes a case 14, a developing sleeve serving as a developer bearing member, a developer containing member 16, a first doctor blade 17 serving as a developer regulating member.

The case 14 has an opening facing the photoreceptor drum 11, and a toner hopper 19 serving as a toner containing member and containing a toner 18 therein is formed in the case 14. At a position of the toner hopper 19 near the photoreceptor drum 11, a developer containing member 16, in which a developer containing portion 16*a* containing a developer 22 including the toner 18 and a magnetic carrier is formed, is arranged while integrated with the case 14. At a position of the case 14 below the developer containing member 16, a projection 14*a* having an opposing face 14*b* is formed. In addition, a toner supplying opening 20 from which the toner 18 is fed is formed between the lower part of the developer containing member 16 and the opposing face 14*b*.

Inside of the toner hopper 19, a toner agitator 21 which is rotated by a driving device (not shown) and which serves as a toner supplier is arranged. The toner agitator 21 feeds the toner 18 in the toner hopper 19 toward the toner supplying opening 20 while agitating the toner 18. In addition, a toner end detecting device 14*c* which detects that the amount of toner 18 present in the toner hopper 19 is small is arranged.

At a space between the photoreceptor drum 11 and the toner hopper 19, the developing sleeve 15 is arranged. The developing sleeve 15 is rotated by a driving member (not shown) in a direction indicated by an arrow. Inside the developing sleeve, a magnet (not shown) which serves as a magnetic field generating member is arranged while the position of the magnet is fixed relative to the developing device 13. At a position of the side of the developer containing member 16 opposite to the side at which the developer containing member 16 is connected with the case 14, the first doctor blade 17 is arranged while integrated with the developer containing member 16. The first doctor blade 17 is arranged such that a gap is formed between the tip edge thereof and the periphery surface of the developing sleeve 15.

At a position of the developer containing member 16 near the toner supplying opening 20, a second doctor blade 23 serving as a regulating member is arranged. The second doctor blade 23 is fixed on the developer containing member 16 such that a space is formed between the tip edge (i.e., the free edge) of the second doctor blade 23 and the periphery surface of the developing sleeve 15 and the tip edge is directed toward the center of the developing sleeve, to regulate the flow of the developer layer.

The developer containing portion 16*a* has a space sufficient to move the developer 22 within the magnetic filed of the developing sleeve while the developer 22 is circulated therein.

The opposing face 14*b* has a predetermined length and is formed so as to be slanted downwardly from the toner hopper side toward the developing sleeve side. By taking such construction, even when the carrier in the developer containing portion 16*a* is dropped from the space formed between the second doctor blade 23 and the developing sleeve 15 due to vibration of the developing device, uneven magnetic field of the magnet inside the developing sleeve 15 and/or partial increase of toner concentration of the developer 22, the dropped carrier is received by the opposing face 14*b* and moves toward the developing sleeve 16. Then the carrier is born on the surface of the developing sleeve 15 by the magnetic force of the magnet and fed again to the developer containing portion 16*a*. Thus, decrease of amount of the carrier in the developer containing portion 16*a* can be prevented. Therefore, a problem in that an image having an uneven image density in the direction of the axis of the developing sleeve 15 is produced can be avoided. The opposing face 14*a* has a slanting angle of about 5°, and a length 1 of from 2 to 20 mm and preferably from 3 to 10 mm.

The toner 18 fed from the toner hopper 19 by the toner agitator 21 is supplied to the developer 22 born by the developing sleeve 15 after passing through the toner supplying opening 20. Then the toner 18 is fed to the developer containing portion 16*a*. The developer 22 in the developer containing portion 16*a* is born on the developing sleeve 15 and fed to a developing position at which the developing sleeve 15 faces the periphery surface of the photoreceptor drum 11. At the developing position, the toner in the developer layer is attracted by an electrostatic latent image formed on the photoreceptor drum 11, resulting in formation of a toner image on the photoreceptor 11.

In FIG. 7, numerals 100 and 101 denote a toner container containing a toner and a developer container containing a developer (i.e. a toner and a carrier). In addition, numeral 12 denotes an image transferer which transfers a toner image on the photoreceptor drum 11 to a receiving material 28. In this case, the toner image is transferred on a receiving material via an intermediate transfer medium (not shown).

Figure 8:
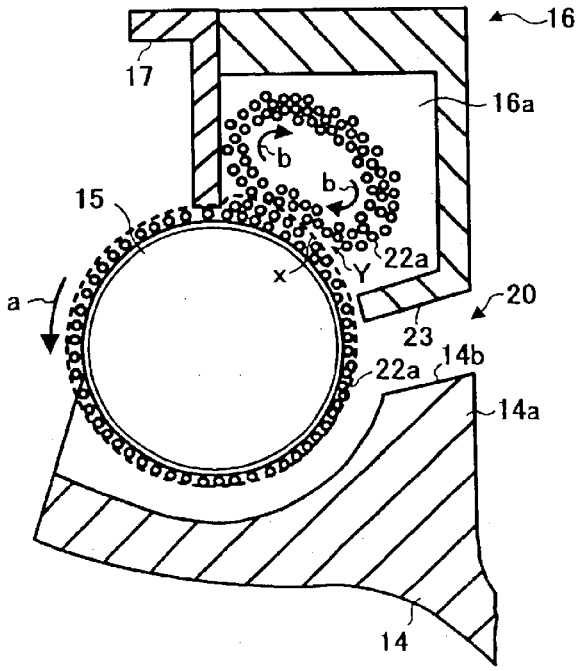
FIGS. 8 to 10 are schematic views for explaining the behavior of the developer in the above image developer.

The behavior of the developer 22 when the toner image is formed will be explained. When a start developer consisting of only a carrier 22*a* is set in the developing device 13, the carrier 22*a* is separated into two groups, one of which is adhered on the surface of the developing sleeve 15 and the other of which is contained in the developer containing portion 16*a*, as shown in FIG. 8.

The carrier 22*a* in the developer containing portion. 16*a* is circulated in a direction indicated by an arrow b at a speed not less than 1 mm/s due to the magnetic force of the magnet. This circulation is caused by the rotation of the developing sleeve 15 in a direction indicated by an arrow a. An interface X is formed between the surface of the carrier born on the surface of the developing sleeve 15 and the surface of the carrier 22*a* circulated in the developer containing portion 16*a*.

Then the toner 18 is contained in the toner hopper 19. When the toner 18 is set, the toner 18 is fed to the magnetic carrier 22*a* born on the developing sleeve 15 from the toner supplying opening 20. Therefore the developing sleeve 15 bears the developer 22 which is a mixture of the toner 18 and the carrier 22*a*.

In the developer containing portion 16*a*, a force is applied against the developer 22 fed by the developing sleeve 15 such that the movement of the developer 22 is stopped because another group of the developer 22 is present in the developer containing portion 16*a*. When the toner present on the surface of the developer 22 born on the surface of the developing sleeve 15 is fed to the interface X, the friction of the developer 22 near the interface X decreases, resulting in decrease of the feeding ability of the developer 22 near the interface X, and thereby the amount of the fed developer 22 neat the interface X is decreased.

Figure 9:
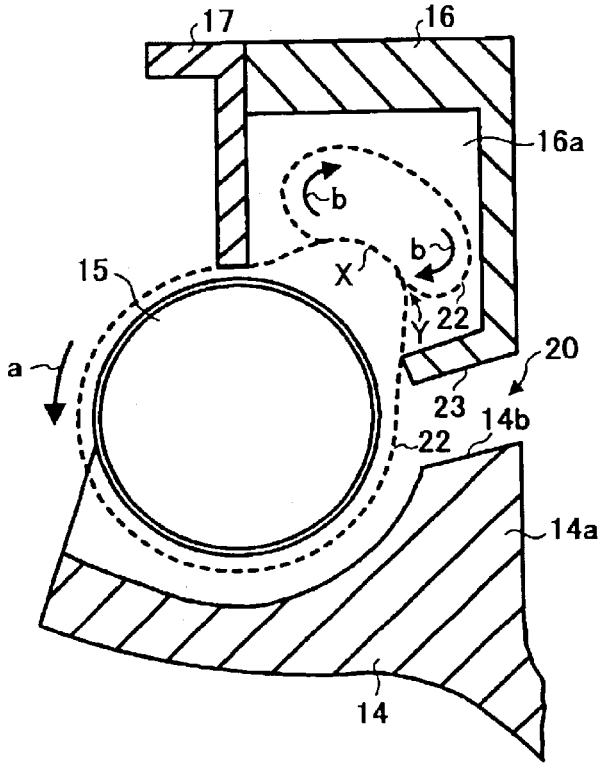

On the other hand, the developer present on the developing sleeve 15 on the upstream side from a junction Y relative to the rotating direction of the developing sleeve 15 does not receive the force which is applied to the developer 22 fed to the developer containing portion 16*a* as mentioned above. Therefore, the amount of the developer 22 fed to the junction Y is unbalanced with the amount of the developer 22 fed in the region of the interface X, resulting in collision of the developer 22. Therefore, the position of the junction Y is heightened, i.e., the layer of the developer 22 including the interface X thickens as shown in FIG. 9. In addition, the layer of the developer formed at a position after the first doctor blade 17 also thickens gradually as shown in FIG. 9. The thickened developer layer is scraped by the second doctor blade 23.

Figure 10:
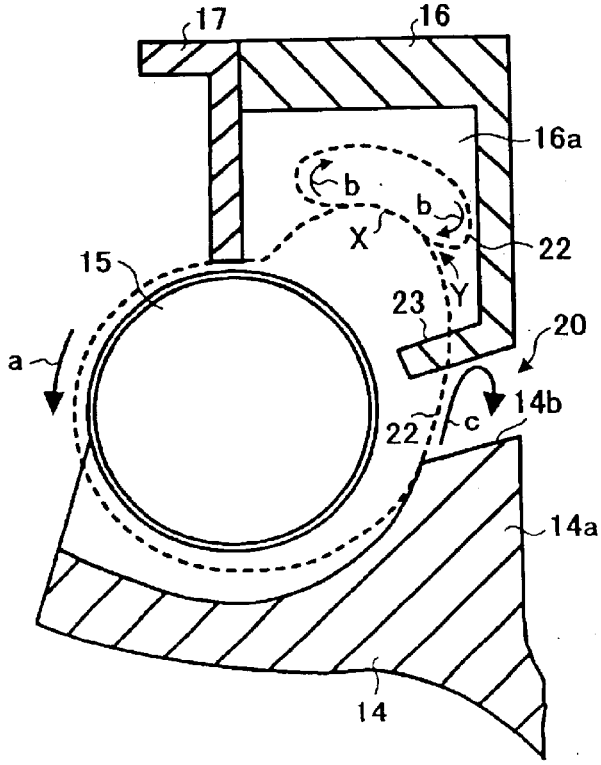

When the toner concentration of the developer 22 passed the first doctor blade 17 reaches a predetermined toner concentration, the developer 22, which is scraped by the second doctor blade 23 and layered, covers the toner supplying opening 20, and thereby the feeding of the toner 18 is stopped, as shown in FIG. 10. At this point, the volume of the developer 22 increases in the developer containing portion 16*a* because the toner concentration thereof increases. Thereby, the free space in the developer containing portion 16*a* is decreased, and the speed of the circulation of the developer 22 in the direction indicated by the arrow b is decreased.

The layer of the developer 22 covering the toner supplying opening 20 is scraped by the second doctor blade 23. As shown by an arrow c in FIG. 10, the scraped developer moves at a speed not less than 1 mm/s and is received by the opposing face 14*b*. Since the opposing face 14*b* is slanted downwardly at an angle of $\alpha$ and has a length L, the developer 22 is prevented from dropping in the toner hopper 19, and thereby the amount of the developer 22 is maintained so as to be uniform. Therefore the toner supply can be self-controlled.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Resin Manufacturing Example

Manufacturing of Non-Linear Polyester Resin (A)

Ten (10) moles of fumaric acid, 4 moles of trimellitic acid, 6 moles of bisphenol A-(2,2)propylene oxide and 4 moles of bisphenol A-(2,2)ethylene oxide were contained in a flask having a stainless steel agitator, a condenser, a nitrogen gas leading tube and a thermometer. The mixture was heated to 220° C. under a nitrogen gas flow while being agitated, to perform a condensation polymerization reaction. Thus a non-linear polyester resin was prepared.

Manufacturing of Linear Polyester Resin (B)

Eight (8) moles of terephthalic acid, 6 moles of bisphenol A-(2,2)propylene oxide and 4 moles of bisphenol A-(2,2) ethylene oxide were contained in a flask having a stainless steel agitator, a condenser, a nitrogen gas leading tube and a thermometer. The mixture was heated to 220° C. under a nitrogen gas flow while being agitated, to perform a condensation polymerization reaction. Thus a linear polyester resin was prepared.

Manufacturing of Hybrid Resin (C)

Twenty (20) moles of styrene and 5 moles of butyl methacrylate, which serve as addition polymerization monomers and 0.4 moles of t-butylhydroperoxide serving as a polymerization initiator were contained in a dropping funnel. On the other hand, 10 moles of fumaric acid serving as a double-reactive monomer capable of addition-polymerizing and condensation-polymerizing, 4 moles of trimellitic anhydride, 6 moles of bisphenol A-(2,2)propylene oxide and 4 moles of bisphenol A-(2,2)ethylene oxide, which are condensation-polymerizable monomers, and 60 moles of dibutyltinoxide serving as an esterifying agent were contained in a flask having a stainless steel agitator, a condenser, a nitrogen gas leading tube and a thermometer. The mixture was heated to 135° C. under a nitrogen gas flow while being agitated.

The above-prepared mixture for addition polymerization was dropped into the flask from the dropping funnel while spending 5 hours. After dropping was completed, the mixture in the flask was aged at 135° C. for 6 hours. Then the mixture was heated to 220° C. to perform a reaction. Thus a hybrid resin was prepared.

The above-mentioned polymerization of each of the polymers A, B and C was performed while the polymerization degree of each polymer was checked by a method in which the softening point of the reaction product was measured by a method based on ASTM E28-67. When the reaction product had predetermined softening point, the polymerization reaction was stopped. Then the reaction product was pulled out of the flask, and pulverized after being cooled. Thus a polymer having predetermined properties was prepared.

Manufacturing of Carrier

The following components were mixed for 20 minutes using a homomixer to prepare a coating liquid.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

Then 1000 parts of a particulate magnetite having a spherical shape and a particle diameter of 50 μm were coated with the coating liquid using a fluidized bed type coating apparatus. Thus a magnetic carrier A was prepared.

Example 1

The following components were mixed in a Henshel mixer.

| | |
|---|---|
| Non-linear polyester resin (A) (acid value of 16.3 mgKOH/g, hydroxyl value of 35.1 mgKOH/g, softening point of 145.1° C., and glass transition temperature of 61.5° C.) | 60 |
| Linear polyester resin (B) (acid value of 2.1 mgKOH/g, hydroxyl value of 34 mgKOH/g, softening point of 100.8° C., and glass transition temperature of 60.3° C.) | 40 |
| Carnauba wax (particle diameter of 400 μm) | 4.5 |
| Carbon black (#44 from Mitsubishi Kasei Corp.) | 8 |
| Zn (II) complex of 3,5-di-tert-butylsalicylic acid | 3 |

The mixture was heated to 130° C. and kneaded for about 30 minutes. The kneaded mixture was cooled to room temperature, and then crushed with a hammer mill to prepare particles having a particle diameter of from 200 to 400 μm. The thus prepared particles were pulverized and classified using a pulverization/classification apparatus IDS-2 (manufactured by Nippon Pneumatic Mfg. Co., Ltd.) in which a pulverizer, in which the particles were collided with a plate using jet air to be pulverized, and a classifier, in which the pulverized particles were circulated in a room to be classified using centrifugal force, are integrated. Thus toner particles were prepared. The particle diameter distribution of the toner particles was measured with a Coulter counter. The result is shown in Table 1.

Then 100 parts of the toner particles, and 0.6 parts of a hydrophobic silica R972 treated with a dichlorodimethylsilane (manufactured by Nippon Aerosil Co., and having an average primary particle diameter of 0.016 μm) and 0.2 parts of hydrophobic titanium oxide T805 treated with octyltrimethoxysilane (manufactured by Nippon Aerosil Co., and having an average particle diameter of 0.02 μm), which serve as external additives, were mixed using a Henshel mixer. Thus a toner was prepared.

Then 4 parts of the toner were mixed with 96 parts of the above-prepared carrier to prepare a developer 1. The developer 1 was evaluated by the methods mentioned below.

Measurements of Coefficient of Static Friction

Three (3) grams of the thus prepared toner was included in a pellet forming die and pressed for 1 minute upon application of load of 6 tons to form a plate-shaped toner pellet having a diameter of 40 mm. The coefficient of static friction of the surface of the pellet was measured with the above-mentioned automatic friction/abrasion analyzer (DFPM-SS manufactured by Kyowa Interface Science Co., Ltd.) using a point contact method. The measuring conditions are as follows:

(1) Contact member: stainless steel ball
(2) Load: 50 g
(3) Stroke: 10 mm

The softening point of the resins used was measured by a method based on JIS K72101 using a flow tester (manufactured by Shimadzu Corp.). The measuring method is as follows:

(1) 1 $cm^3$ of a resin sample is set in a cell and pressed by a pressure of 20 $Kg/cm^2$ while being heated at a temperature rising speed of 6° C./min to extrude the resin sample from a nozzle of 1 mm in diameter and 1 mm in length;
(2) graphing the relationship between temperature and the amount of drop of the plunger; and
(3) provided that the height of the thus prepared S-shaped curve is h, the softening point of the resin is defined as the temperature corresponding to the point of h/2 on the curve (i.e., the temperature at which half of the resin sample flows away).

The acid value and hydroxyl value of resins are measured by methods based on JIS K0070.

The glass transition temperature of resins are measured using a differential scanning calorimeter DSC-60 manufactured by Shimadzu Corp. The measuring method is as follows:

(1) a resin sample is heated from room temperature to 200° C. at a temperature rising speed of 10° C./min, and then cooled at a temperature falling speed of 10° C./min; and
(2) the glass transition temperature (Tg) is defined as the temperature corresponding to a middle point of the base line 1 in which the temperature is below the Tg and the base line
2 in which the temperature is above the Tg.

Examples 2, 3 and 4

The procedures for preparation and evaluation of the toner and developer in Example 1 were repeated except that the particle diameter distribution of the toner particles was changed as described in Table 1 by changing the amount of the particles supplied to the pulverization/classification apparatus and the pulverizing air pressure.

Example 5

The procedures for preparation and evaluation of the toner and developer in Example 1 were repeated except that the carnauba wax was replaced with a rice wax (particle diameter of 500 μm) when the toner was prepared.

Example 6

The procedures for preparation and evaluation of the toner and developer in Example 1 were repeated except that the addition amount of the carnauba wax was changed to 3 parts.

Example 7

The procedures for preparation and evaluation of the toner and the developer in Example 1 were repeated except that the temperature of the roll mill was changed to 100° C. in the kneading process.

Example 8

The following components were mixed using a Henshel mixer.

| | |
|---|---|
| Non-linear polyester resin (A) (acid value of 27.5 mgKOH/g, hydroxyl value of 37.5 mgKOH/g, softening point of 148.5° C., and glass transition temperature of 60° C.) | 40 |
| Linear polyester resin (B) (acid value of 10.1 mgKOH/g, hydroxyl value of 46.8 mgKOH/g, softening point of 98.8° C., and glass transition temperature of 60.5° C.) | 60 |
| Carnauba wax (particle diameter of 400 μm) | 4.5 |
| Carbon black (#44 from Mitsubishi Kasei Corp.) | 8 |
| Fe (III) complex of 3,5-di-tert-butylsalicylic acid | 3 |

The mixture was heated to 130° C. and kneaded for 30 minutes using a roll mill. The kneaded mixture was cooled to room temperature, and then crushed with a hammer mill to prepare particles having a particle diameter of from 200 to 400 μm. The thus prepared particles were pulverized and classified using a pulverization/classification apparatus IDS-2 (manufactured by Nippon Pneumatic Mfg. Co., Ltd.). Thus toner particles were prepared.

Then 100 parts of the toner particles, and 0.6 parts of a hydrophobic silica R972 treated with a dichlorodimethylsilane (manufactured by Nippon Aerosil Co., and having an average primary particle diameter of 0.016 μm) and 0.2 parts of hydrophobic titanium oxide T805 treated with octyltrimethoxysilane (manufactured by Nippon Aerosil Co., and having an average particle diameter of 0.02 μm), which serve as external additives, were mixed using a Henshel mixer. Thus a toner was prepared.

Then 4 parts of this toner were mixed with 96 parts of the carrier A using a ball mill. Thus, a two component developer 8 was prepared.

Example 9

The procedures for preparation and evaluation of the toner and the developer in Example 8 were repeated except that the toner constituents were changed as follows:

| | |
|---|---|
| Non-linear polyester resin (A) | 34 |
| Linear polyester resin (B) | 54 |
| Hybrid resin (C) (acid value of 24.5 mgKOH/g, hydroxyl value of 25.1 mgKOH/g, softening point of 113.5° C., and glass transition temperature of 59.5° C.) | 15 |

(acid value of 24.5 mgKOH/g, hydroxyl value of 25.1 mgKOH/g, softening point of 113.5° C., and glass transition temperature of 59.5° C.)

Comparative Example 1

The procedures for preparation and evaluation of the toner and the developer in Example 1 were repeated except that the particle diameter of the carnauba wax was changed to 2 mm and the addition amount of the carnauba wax was changed to 20 parts. The friction coefficient of the surface of the toner was 0.14.

Comparative Example 2

The procedures for preparation and evaluation of the toner and the developer in Example 1 were repeated except that the temperature of the roll mill in the kneading process was changed to 160° C. The friction coefficient of the surface of the toner was 0.18.

Comparative Example 3

The procedures for preparation and evaluation of the toner and the developer in Example 1 were repeated except that the addition amount of the hydrophobic silica was changed to 0.3% and the hydrophobic titanium oxide was not added. The friction coefficient of the surface of the toner was 0.19.

Comparative Example 4

The procedures for preparation and evaluation of the toner and the developer in Example 1 were repeated except that the addition amount of the carnauba wax was changed to 1.5% and the addition amounts of the hydrophobic silica and the hydrophobic titanium oxide were changed to 2.0% and 1.0%, respectively. The friction coefficient of the surface of the toner was 0.45.

The thus prepared toners and developers were evaluated as follows.

Filming

Each of the toners and its developer were set in a filming-evaluating copying machine, a modified IMAGIO MF-200 manufactured by Ricoh Co., Ltd. whose developing unit was modified, to perform a running test in which 100,000 copies are produced at room temperature. At the $20{,}000^{th}$ image, $_{50{,}000}{}^{th}$ image and $100{,}000^{th}$ image, the image was observed to determine whether the toner was filmed on the photoreceptor and whether the image had an abnormal image (i.e., a white stripe image in half tone images).

Whether the film was formed on the photoreceptor can be judged by the following method.

Copy papers of A-3 size, which had been stored for 2 hours under the environmental conditions of 30° C. and 90% RH, were set in the copying machine. Half tone images formed of 1 dot image (1 dot×1 dot) were output. The image densities of the darkest area and the lightest area of the stripe images were measured with a Macbeth densitometer to determine the difference of the image densities. The filming was evaluated by being classified into the following 5 grades.

◎: the density difference is not greater than 0.05. (excellent)

○: the density difference is from 0.06 to 0.10.

□: the density difference is from 0.11 to 0.25.

Δ: the density difference is from 0.26 to 0.40.

X: the density difference is not less than 0.41. (worst)

When the film was not formed, the difference of image densities is 0.00. The larger the density difference, the worse the filming phenomenon. In addition, the greater the number of copied images, the worse the filming phenomenon.

2. Reproducibility of Fine Lines

A line image including vertical and horizontal lines having densities of 2.0, 2.2, 2.5, 2.8, 3.2, 3.6, 4.0, 4.5, 5.0, 5.6, 6.3 and 7.1 lines/mm was produced using a copier IMAGIO MF-200 manufactured by Ricoh Co., Ltd. The line image was observed whether the line images can be faithfully reproduced. The fine-line reproducibility of the image was classified into the following 5 grades.

◎: the lines having a density of from 6.3 to 7.1 lines/mm can be reproduced. (excellent)

○: the lines having a density of from 5.0 to 5.6 lines/mm can be reproduced.

□: the lines having a density of from 4.0 to 4.5 lines/mm can be reproduced. Δ: the lines having a density of from 2.8 to 3.6 lines/mm can be reproduced.

X: the lines having a density of from 2.0 to 2.5 lines/mm can be reproduced. (worst)

3. Fixability

The fixability of each toner was evaluated using a copier, Ricoh IMAGIO MF-200 having a modified fixing section in which a Teflon roller was used as a fixing roller, and a TYPE 6200 copy paper manufactured by Ricoh Co., Ltd. Images were produced while the fixing temperature was changed. The image forming conditions of the copier for checking cold and hot offset problems were as follows.

Cold Offset

Paper feeding speed: 140 mm/s

Surface pressure of the fixing roller: 1.2 Kgf/cm$^2$

Nip width of the fixing area: 3 mm

Hot Offset

Paper feeding speed: 50 mm/s

Surface pressure of the fixing roller: 2.0 Kgf/cm$^2$

Nip width of the fixing area: 4.5 mm

The cold offset resistance and hot offset resistance of the toners were classified into the following 5 grades.

Cold Offset Resistance

⊙: cold offset is observed at a temperature not higher than 125° C. (excellent)

○: cold offset is observed at a temperature not lower than 125° C. and not higher than 135° C.

□: cold offset is observed at a temperature not lower than 135° C. and not higher than 145° C.

Δ: cold offset is observed at a temperature not lower than 145° C. and not higher than 155° C.

X: cold offset is observed at a temperature not lower than 155° C. (worst)

Hot Offset Resistance

⊙: hot offset is observed at a temperature not lower than 201° C. (excellent)

○: hot offset is observed at a temperature of from 191° C. to 200° C.

□: hot offset is observed at a temperature of from 181° C. to 190° C.

Δ: hot offset is observed at a temperature of from 171° C. to 180° C.

X: hot offset is observed at a temperature not higher than 170° C. (worst)

4 High Temperature Preservability

Twenty (20) grams of a toner sample was contained in a glass container having a volume of 20 ml. The glass container including the toner was allowed to settle in an oven of 60° C. for 4 hours. Then the toner was cooled and subjected to a penetration test by a method based on JIS K2235-1991.

The high temperature preservability is classified into the following 4 grades.

⊙: penetration is not less than 10 mm. (excellent)

○: penetration is from 5.0 to 9.9 mm.

Δ: penetration is from 3.0 to 4.9 mm.

X: penetration is from 0 to 2.9 mm. (worst)

5. Background Fouling

A white image of A-3 size was formed after the 100,000 sheets running test mentioned above. The average image density of the white image was determined by measuring the densities of six points of the white image. Then the density difference between the average image density of the white image and the image density of the paper which did not pass the copy machine was determined. The density difference was classified into the following 5 grades to evaluate background fouling.

⊙: the density difference is not greater than 0.02. (excellent)

○: the density difference is from 0.03 to 0.05.

□: the density difference is from 0.06 to 0.08.

Δ: the density difference is from 0.09 to 0.11.

X: the density difference is not less than 0.12. (worst)

TABLE 1

| | $\mu_0$ | D4 (μm) | P (% by number) | Filming At 20,000th image | Filming At 50,000th image | Filming At 100,000th image |
|---|---|---|---|---|---|---|
| Ex. 1 | 0.26 | 9.5 | 25 | ⊙ | ⊙ | ○ |
| Ex. 2 | 0.27 | 6.5 | 62 | ⊙ | ⊙ | ○ |
| Ex. 3 | 0.28 | 7.7 | 60 | ⊙ | ⊙ | ○ |
| Ex. 4 | 0.21 | 4.8 | 81 | ⊙ | ○ | ○ |
| Ex. 5 | 0.23 | 9.6 | 24 | ⊙ | ⊙ | ○ |
| Ex. 6 | 0.39 | 9.4 | 27 | ⊙ | ⊙ | ⊙ |
| Ex. 7 | 0.29 | 9.5 | 25 | ⊙ | ⊙ | ○ |
| Ex. 8 | 0.28 | 6.7 | 63 | ⊙ | ⊙ | ○ |
| Ex. 9 | 0.33 | 6.6 | 62 | ⊙ | ⊙ | ⊙ |
| Comp. Ex. 1 | 0.14 | 9.5 | 25 | x | — | — |
| Comp. Ex. 2 | 0.18 | 9.6 | 25 | □ | x | — |
| Comp. Ex. 3 | 0.19 | 9.5 | 26 | ○ | Δ | x |
| Comp. Ex. 4 | 0.45 | 9.5 | 24 | ⊙ | ⊙ | ⊙ |

$\mu_0$: Coefficient of static friction of the surface of the toner
D4: Volume average particle diameter of the toner particles
P: Percentage of toner particles having a particle diameter not greater than 5 μm

| | Fine line reproducibility | Cold offset resistance | Hot offset resistance | Preservability | Background fouling |
|---|---|---|---|---|---|
| Ex. 1 | ○ | ○ | ○ | ○ | ○ |
| Ex. 2 | ⊙ | ○ | ○ | ○ | ○ |
| Ex. 3 | ⊙–○ | ○ | ○ | ○ | ○ |
| Ex. 4 | ⊙ | ○ | ○ | ○ | ○ |
| Ex. 5 | ○ | ○ | ○ | ○ | ○ |
| Ex. 6 | ○ | ○ | ○ | ○ | ○ |
| Ex. 7 | ○ | ○ | ○ | ○ | ○ |
| Ex. 8 | ⊙ | ⊙ | ⊙ | ○ | ○ |
| Ex. 9 | ⊙ | ⊙ | ⊙ | ⊙ | ○ |
| Comp. Ex. 1 | □ | ○ | ⊙ | x | Δ |
| Comp. Ex. 2 | ○ | ○ | ○ | Δ | □ |
| Comp. Ex. 3 | Δ | ○ | ○ | Δ | Δ |
| Comp. Ex. 4 | ○ | ○ | x | ○ | ○ |

As can be understood from Table 1, by using the toner of the present invention, and image forming method and apparatus using the toner, good images can be produced for a long period of time without causing the offset and filming problems even when mechanical and thermal stresses are applied thereto.

This document claims priority and contains subject matter related to Japanese Patent Applications No. 2000-298734, 2000-324957, 2001-026396 and 2001-233944, filed on Sep. 29, 2000, Oct. 25, 2000, Feb. 2, 2001 and Aug. 1, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising:

forming a toner image on a receiving material; and passing the receiving material through a nip between two fixing members A and B while applying a pressure to the fixing members A and B to fix the toner image on the receiving material upon application of heat and pressure, wherein the receiving material contacts the fixing member A, and wherein the toner comprises toner particles, said particles comprising a binder resin and a release agent, and when the toner is pressed upon application of a pressure of 478 kg/cm$^2$ to form a toner plate, the toner plate has a surface having a coefficient of static friction of from 0.20 to 0.40.

2. The image forming method according to claim 1, wherein the fixing member A has a thickness of 0.7 mm, and wherein the pressure is not greater than $1.5\times10^5$ Pa.

3. The image forming method according to claim 1, wherein the fixing member A is at least one of a belt or an endless belt and is heated by a fixed heater.

4. A developing device comprising:

a developer bearing member having a magnetic field generating means therein and configured to bear a developer comprising a magnetic carrier and a magnetic toner composition while rotating;

a first regulation member configured to regulate the amount of the developer supplied to the developer bearing member to form a developer layer on the developer bearing member;

a developer containing member configured to contain the developer scraped by the first regulating member; and a toner containing member located adjacent to the developer containing member and configured to supply the magnetic toner composition to the developer bearing member through an opening, wherein the developer containing member comprises:

a second regulating member located on an upstream side from the first regulating member relative to the rotating direction of the developer bearing member, and configured to scrape the developer layer when a concentration of the magnetic toner in the developer layer increases and the developer layer thickens, to cover the opening with the scraped developer to stop the supply of the magnetic toner composition from the toner containing member, and wherein the magnetic toner composition comprises toner particles, said particles comprising a magnetic material, a binder resin and a release agent, and when the magnetic toner composition is pressed upon application of a pressure of 478 kg/cm$^2$ to form a toner plate, the toner plate has a surface having a coefficient of static friction of from 0.20 to 0.40.

* * * * *